US010446910B2

(12) United States Patent
Han et al.

(10) Patent No.: US 10,446,910 B2
(45) Date of Patent: Oct. 15, 2019

(54) ELECTRONIC DEVICE WITH ANTENNA

(71) Applicant: Samsung Electronics Co., Ltd., Gyeonggi-do (KR)

(72) Inventors: Sang Min Han, Seongnam-si (KR); Young Jung Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 166 days.

(21) Appl. No.: 15/437,396

(22) Filed: Feb. 20, 2017

(65) Prior Publication Data

US 2017/0244151 A1 Aug. 24, 2017

(30) Foreign Application Priority Data

Feb. 20, 2016 (KR) ..... 10-2016-0020121

(51) Int. Cl.

| | |
|---|---|
| ***H01Q 1/24*** | (2006.01) |
| ***H01Q 5/30*** | (2015.01) |
| ***H01Q 1/48*** | (2006.01) |
| ***H01Q 21/00*** | (2006.01) |
| ***H01Q 9/42*** | (2006.01) |
| ***H01Q 21/30*** | (2006.01) |
| ***H01Q 5/328*** | (2015.01) |
| ***H01Q 5/335*** | (2015.01) |

(52) U.S. Cl.

CPC ..... *H01Q 1/241* (2013.01); *H01Q 1/243* (2013.01); *H01Q 1/48* (2013.01); *H01Q 5/30* (2015.01); *H01Q 5/328* (2015.01); *H01Q 5/335* (2015.01); *H01Q 9/42* (2013.01); *H01Q 21/00* (2013.01); *H01Q 21/30* (2013.01)

(58) Field of Classification Search

CPC ..... H01Q 21/30; H01Q 5/30; H01Q 1/243

See application file for complete search history.

(56) References Cited

U.S. PATENT DOCUMENTS

| | | | | |
|---|---|---|---|---|
| 2013/0135157 | A1* | 5/2013 | Tsou | H01Q 1/2266 343/702 |
| 2013/0267284 | A1* | 10/2013 | Ryu | H04W 88/06 455/575.7 |
| 2014/0078008 | A1* | 3/2014 | Kang | H01Q 5/35 343/702 |
| 2015/0017929 | A1* | 1/2015 | Ljung | H04B 7/0608 455/73 |
| 2015/0200462 | A1 | 7/2015 | Leppaluoto | |

(Continued)

*Primary Examiner* — Ricardo I Magallanes

(57) ABSTRACT

An electronic device includes a first antenna radiator configured to transmit or receive a signal of a first frequency band and a signal of a second frequency band, a second antenna radiator configured to transmit or receive the signal of the second frequency band, a matching circuit mismatched with the second antenna radiator in the first frequency band and matched with the second antenna radiator in the second frequency band, a radio frequency circuit electrically connected to the first antenna radiator and the second antenna radiator, and a processor configured to control the RF circuit such that the signal of the second frequency band is transmitted or received through the first antenna radiator and the second antenna radiator in a multi-input multi-output mode or such that the signal of the first frequency band is transmitted or received through the first antenna radiator in a single input single output mode.

18 Claims, 14 Drawing Sheets

(56) References Cited

U.S. PATENT DOCUMENTS

| | | | | |
|---|---|---|---|---|
| 2015/0255853 | A1* | 9/2015 | Kwong | H01Q 1/44 343/702 |
| 2015/0333779 | A1* | 11/2015 | Itkin | H04B 1/0475 455/77 |
| 2015/0380818 | A1 | 12/2015 | Svendsen et al. | |
| 2016/0276748 | A1* | 9/2016 | Ramachandran | H01Q 21/28 |
| 2017/0078892 | A1* | 3/2017 | Shen | H04W 24/10 |

* cited by examiner

ELECTRONIC DEVICE WITH ANTENNA

CROSS-REFERENCE TO RELATED APPLICATION(S) AND CLAIM OF PRIORITY

The present application is related to and claims the benefit under 35 U.S.C. § 119(a) of a Korean patent application filed on Feb. 20, 2016 in the Korean Intellectual Property Office and assigned Serial number 10-2016-0020121, the entire disclosure of which is hereby incorporated by reference.

TECHNICAL FIELD

This disclosure relates to a technique capable of improving the efficiency of a plurality of antennas included in an electronic device.

BACKGROUND

Wireless communication technology may enable various types of information, such as a text, an image, a video, audio, and the like, to be transmitted and/or received. Such wireless communication technology has been developed to transmit and receive much more information at a higher rate. As wireless communication technology is developed, a communicable electronic device such as a smartphone, a tablet computer, and the like, may provide a service using a communication function such as digital multimedia broadcasting (DMB), global positioning system (GPS), Wi-Fi, long-term evolution (LTE), near field communication (NFC), magnetic stripe transmission (MST), and the like. The electronic device may include at least one antenna to provide such a service. The electronic device may transmit and receive a signal through at least two multi-input and multi-output (MIMO) antennas.

The electronic device may transmit and receive a signal in a MIMO mode or a single input single output (SISO) mode. When the electronic device transmits and/or receives a signal in the SISO mode, the performance of an antenna transmitting and/or receiving the signal may be deteriorated due to an influence of another antenna which may be together used to transmit and receive a signal in the MIMO mode.

SUMMARY

To address the above-discussed deficiencies, it is a primary object to provide at least the advantages described below. Accordingly, an aspect of the present disclosure is to provide an electronic device with an antenna, which is capable of preventing the performance from being deteriorated when a MIMO mode switches to a SISO mode.

In accordance with an aspect of the present disclosure, an electronic device includes a first antenna radiator that transmits or receives a signal of a first frequency band and a signal of a second frequency band, a second antenna radiator that transmits or receives the signal of the second frequency band, wherein at least a part of the second antenna radiator is arranged to be coupled with the first antenna radiator and includes a pattern having an electrical length corresponding to the first frequency band, a matching circuit electrically connected to the second antenna radiator, wherein the matching circuit is mismatched with the second antenna radiator in the first frequency band and is matched with the second antenna radiator in the second frequency band, a radio frequency (RF) circuit electrically connected to the first antenna radiator and the second antenna radiator, and a processor that controls the RF circuit such that the signal of the second frequency band is transmitted or received through the first antenna radiator and the second antenna radiator in a multi-input multi-output (MIMO) mode or such that the signal of the first frequency band is transmitted or received through the first antenna radiator in a single input single output (SISO) mode.

In accordance with another aspect of the present disclosure, an electronic device includes a first antenna radiator that transmits or receives a signal of a first frequency band and a signal of a second frequency band, a second antenna radiator that transmits or receives the signal of the first frequency band and the signal of the second frequency band, wherein the second antenna radiator includes a first pattern having an electrical length corresponding to the first frequency band, and a second pattern having an electrical length corresponding to the second frequency band, and the first pattern is arranged to be coupled with the first antenna radiator, a tuning pattern electrically connected to the second antenna radiator, a radio frequency (RF) circuit electrically connected to the first antenna radiator and the second antenna radiator, and a processor that controls the tuning circuit such that the second antenna radiator is matched in the first frequency band when the RF circuit transmits or receives the signal of the first frequency band through the first antenna radiator and the second antenna radiator in a multi-input multi-output (MIMO) mode, and such that the second antenna radiator is mismatched in the first frequency band when the RF circuit transmits or receives the signal of the first frequency band through the first antenna radiator in a single-input single-output (SISO) mode.

In accordance with an aspect of the present disclosure, an electronic device includes a housing including a first surface facing a first direction, a second surface facing a second direction opposite to the first direction, and a side surface surrounding at least a part of a space between the first surface and the second surface, a first elongated conductive member defining a first part of the side surface and having a first end, a second elongated conductive member defining a second part of the side surface and having a second end adjacent to the first end, a non-conductive member defining a third part of the side surface and inserted between the first end and the second end, a first conductive pattern arranged inside of the housing to be closer to the first elongated conductive member than the second elongated conductive member, a second conductive pattern arranged inside of the housing to be closer to the second elongated conductive member than the first elongated conductive member, and a wireless communication circuit electrically connected to the first elongated conductive member and the first conductive pattern to transmit and/or receive a signal of a first frequency band, and/or electrically connected to the first conductive pattern and the second conductive pattern to transmit and/or receive a signal of a second frequency band higher than the first frequency band, wherein the second conductive pattern includes an elongated conductive part and is adjacent to the second elongated conductive member.

Other aspects, advantages, and salient features of the disclosure will become apparent to those skilled in the art from the following detailed description, which, taken in conjunction with the annexed drawings, discloses various embodiments of the present disclosure.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

Throughout the drawings, it should be noted that like reference numbers are used to depict the same or similar elements, features, and structures.

DETAILED DESCRIPTION

Figure 1:
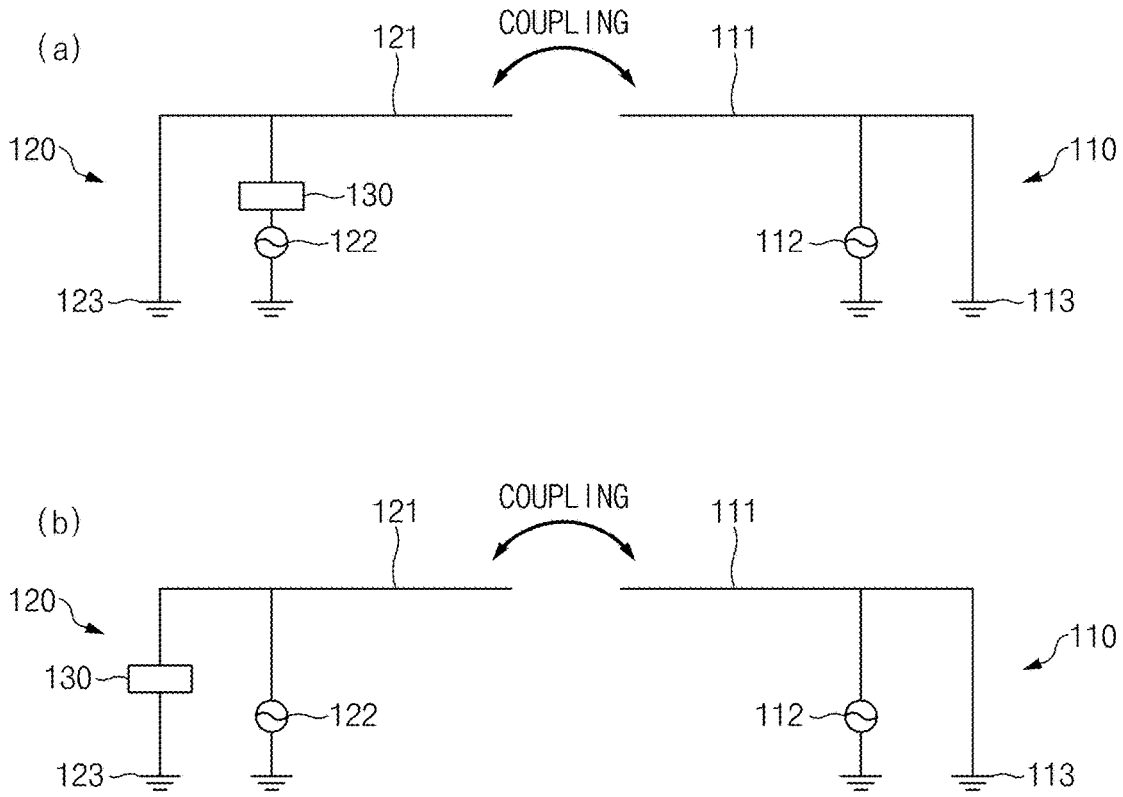
FIG. 1 illustrates an example antenna included an electronic device according to an embodiment of the present disclosure.

FIGS. 1 through 11, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged electronic device.

Various embodiments of the present disclosure may be described with reference to accompanying drawings. Accordingly, those of ordinary skill in the art will recognize that modification, equivalent, and/or alternative on the various embodiments described herein may be variously made without departing from the scope and spirit of the present disclosure. With regard to description of drawings, similar elements may be marked by similar reference numerals.

In the disclosure disclosed herein, the expressions "have", "may have", "include" and "comprise", or "may include" and "may comprise" used herein indicate existence of corresponding features (e.g., elements such as numeric values, functions, operations, or components) but do not exclude presence of additional features.

In the disclosure disclosed herein, the expressions "A or B", "at least one or more of A or/and B", or "one or more of A or/and B", and the like used herein may include any and all combinations of one or more of the associated listed items. For example, the term "A or B", "at least one or more of A and B", or "at least one or more of A or B" may refer to all of the case (1) where at least one A is included, the case (2) where at least one B is included, or the case (3) where both of at least one A and at least one B are included.

The terms, such as "first", "second", and the like used herein may refer to various elements of various embodiments of the present disclosure, but do not limit the elements. For example, "a first user device" and "a second user device" indicate different user devices regardless of the order or priority. For example, without departing the scope of the present disclosure, a first element may be referred to as a second element, and similarly, a second element may be referred to as a first element.

It will be understood that when an element (e.g., a first element) is referred to as being "(operatively or communicatively) coupled with/to" or "connected to" another element (e.g., a second element), it may be directly coupled with/to or connected to the other element or an intervening element (e.g., a third element) may be present. In contrast, when an element (e.g., a first element) is referred to as being "directly coupled with/to" or "directly connected to" another element (e.g., a second element), it should be understood that there are no intervening element (e.g., a third element).

According to the situation, the expression "configured to" used herein may be used as, for example, the expression "suitable for", "having the capacity to", "designed to", "adapted to", "made to", or "capable of". The term "configured to" must not mean only "specifically designed to" in hardware. Instead, the expression "a device configured to" may mean that the device is "capable of" operating together with another device or other components. CPU, for example, a "processor configured to perform A, B, and C" may mean a dedicated processor (e.g., an embedded processor) for performing a corresponding operation or a generic-purpose processor (e.g., a central processing unit (CPU) or an application processor) which may perform corresponding operations by executing one or more software programs which are stored in a memory device.

Terms used in this disclosure are used to describe specified embodiments of the present disclosure and are not intended to limit the scope of the present disclosure. The terms of a singular form may include plural forms unless otherwise specified. All the terms used herein, which include technical or scientific terms, may have the same meaning that is generally understood by a person skilled in the art. It will be further understood that terms, which are defined in a dictionary and commonly used, should also be interpreted as is customary in the relevant related art and not in an idealized or overly formal detect unless expressly so defined herein in various embodiments of the present disclosure. In some cases, even if terms are terms which are defined in the disclosure, they may not be interpreted to exclude embodiments of the present disclosure.

An electronic device according to various embodiments of the present disclosure may include at least one or more of smartphones, tablet personal computers (PCs), mobile phones, video telephones, electronic book readers, desktop PCs, laptop PCs, netbook computers, workstations, servers, personal digital assistants (PDAs), portable multimedia players (PMPs), motion picture experts group (MPEG-1 or MPEG-2) audio layer 3 (MP3) players, mobile medical devices, cameras, or wearable devices. According to various embodiments, the wearable device may include at least one or more of an accessory type (e.g., watches, rings, bracelets, anklets, necklaces, glasses, contact lens, or head-mounted-devices (HMDs), a fabric or garment-integrated type (e.g., an electronic apparel), a body-attached type (e.g., a skin pad or tattoos), or an implantable type (e.g., an implantable circuit).

According to various embodiments, the electronic device may be a home appliance. The home appliances may include at least one or more of, for example, televisions (TVs), digital versatile disc (DVD) players, audios, refrigerators, air conditioners, cleaners, ovens, microwave ovens, washing machines, air cleaners, set-top boxes, TV boxes (e.g., Samsung HomeSync™, Apple TV™, or Google TV™), game consoles (e.g., Xbox™ and PlayStation™), electronic dictionaries, electronic keys, camcorders, electronic picture frames, and the like.

According to another embodiment, the photographing apparatus may include at least one or more of medical devices (e.g., various portable medical measurement devices (e.g., a blood glucose monitoring device, a heartbeat measuring device, a blood pressure measuring device, a body temperature measuring device, and the like), a magnetic resonance angiography (MRA), a magnetic resonance imaging (MRI), a computed tomography (CT), scanners, and ultrasonic devices), navigation devices, global navigation satellite system (GNSS), event data recorders (EDRs), flight data recorders (FDRs), vehicle infotainment devices, electronic equipment for vessels (e.g., navigation systems and gyrocompasses), avionics, security devices, head units for vehicles, industrial or home robots, automatic teller's machines (ATMs), points of sales (POSs), or internet of things (e.g., light bulbs, various sensors, electric or gas meters, sprinkler devices, fire alarms, thermostats, street lamps, toasters, exercise equipment, hot water tanks, heaters, boilers, and the like).

According to an embodiment, the electronic device may include at least one or more of parts of furniture or buildings/structures, electronic boards, electronic signature receiving devices, projectors, or various measuring instruments (e.g., water meters, electricity meters, gas meters, or wave meters, and the like). According to various embodiments, the electronic device may be one of the above-described devices or a combination thereof. An electronic device according to an embodiment may be a flexible electronic device. Furthermore, an electronic device according to an embodiment of the present disclosure may not be limited to the above-described electronic devices and may include other electronic devices and new electronic devices according to the development of technologies.

Hereinafter, electronic devices according to various embodiments will be described with reference to the accompanying drawings. The term "user" used herein may refer to a person who uses an electronic device or may refer to a device (e.g., an artificial intelligence electronic device) that uses an electronic device.

FIG. 1 illustrates an example antenna included an electronic device according to an embodiment of the present disclosure.

Referring to FIG. 1, an electronic device according to an embodiment of the present disclosure may include a first antenna 110 and a second antenna 120. The first antenna 110 may include a first antenna radiator 111, a first feeding unit 112, and a first ground unit 113. The second antenna 120 may include a second antenna radiator 121, a second feeding unit 122, a second ground unit 123, and a matching circuit 130.

The first antenna radiator 111 may transmit and receive a signal of a first frequency band and a signal of a second frequency band. For example, the first frequency band may include a band of 2.4 GHz to 2.8 GHz. For example, the second frequency band may include a band of 5 GHz to 5.8 GHz. The first antenna radiator 111 may transmit and receive a signal of the first frequency band or the second frequency band in a multi-input multi-output (MIMO) mode together with the second antenna radiator 121. The first antenna radiator 111 may transmit and receive a signal of the first frequency band or the second frequency hand in a single-input single-output (SISO) mode. The first antenna radiator 111 may be electrically connected to the first feeding unit 112 and the first around unit 113.

The first antenna radiator 111 may be arranged to be adjacent to the second antenna radiator 121. The first antenna radiator 111 may be coupled with the second antenna radiator 121. Due to the coupling with the second antenna radiator 121, the resonance property of the first antenna radiator 111 in the first frequency band and/or the second frequency band may be changed. Specifically, in the case that the first antenna radiator 111 transmits and/or receives a signal of the first frequency band in the SISO mode, due to the coupling with the second antenna radiator 121, the efficiency of the first antenna radiator 111 for the first frequency band may be deteriorated.

The second antenna radiator 121 may transmit and receive a signal of the second frequency band. The second antenna radiator 121 may transmit and receive a signal of the first frequency band and a signal of the second frequency band. The second antenna radiator 121 may transmit and receive a signal of the first frequency band or the second frequency band in the MIMO mode together with the first antenna radiator. 111. While the first antenna radiator 111 transmits and/or receives the signal of the first frequency band or the second frequency band in the SISO mode, the second antenna radiator 121 may be in an idle state. The second antenna radiator 121 may be electrically connected to the second feeding unit 122 and the second ground unit 123.

The matching circuit 130 may be electrically connected to the second antenna radiator 121. The matching circuit 130 may be interposed between the second feeding unit 122 and the second antenna radiator 121 or may be interposed between the second ground unit 123 and the second antenna radiator 121. For example, the matching circuit 130 may include a tunable circuit component such as a switch, a tuner, a variable capacitor, or the like. According to an embodiment, the matching circuit 130 may be configured to allow the second antenna radiator 121 to be impedance-mismatched in the first frequency band. If the impedance of the second antenna radiator 121 is matched in the first frequency band, for example, if the first antenna radiator 111 transmits and receives a signal of the first frequency band in the SISO mode, due to the coupling with the second antenna radiator 121, the efficiency of the first antenna radiator 111 may be deteriorated in the first frequency band. The influence of the second antenna radiator 121 on the first antenna radiator 111 may be reduced in the first frequency band by connecting the matching circuit 130, which is configured to be mismatched with the second antenna radiator 121 in the first frequency band, to the second antenna radiator 121, and thus, the efficiency of the first antenna radiator 111 may be prevented from being deteriorated.

Hereinafter, the detailed structures of the first antenna radiator 111 and the second antenna radiator 121 will be described in detail with reference to FIGS. 2 and 3.

Figure 2A:
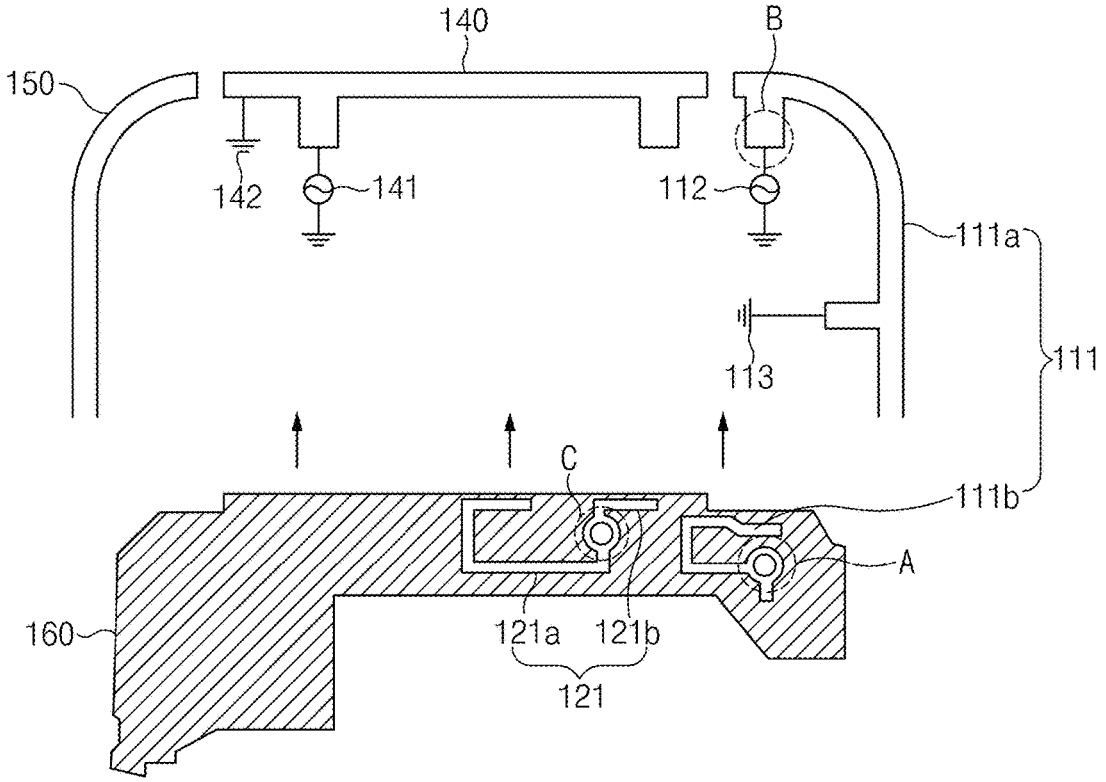
FIGS. 2A and 2B illustrate an example structure of an antenna included in an electronic device according to an embodiment of the present disclosure.
Figure 2B:
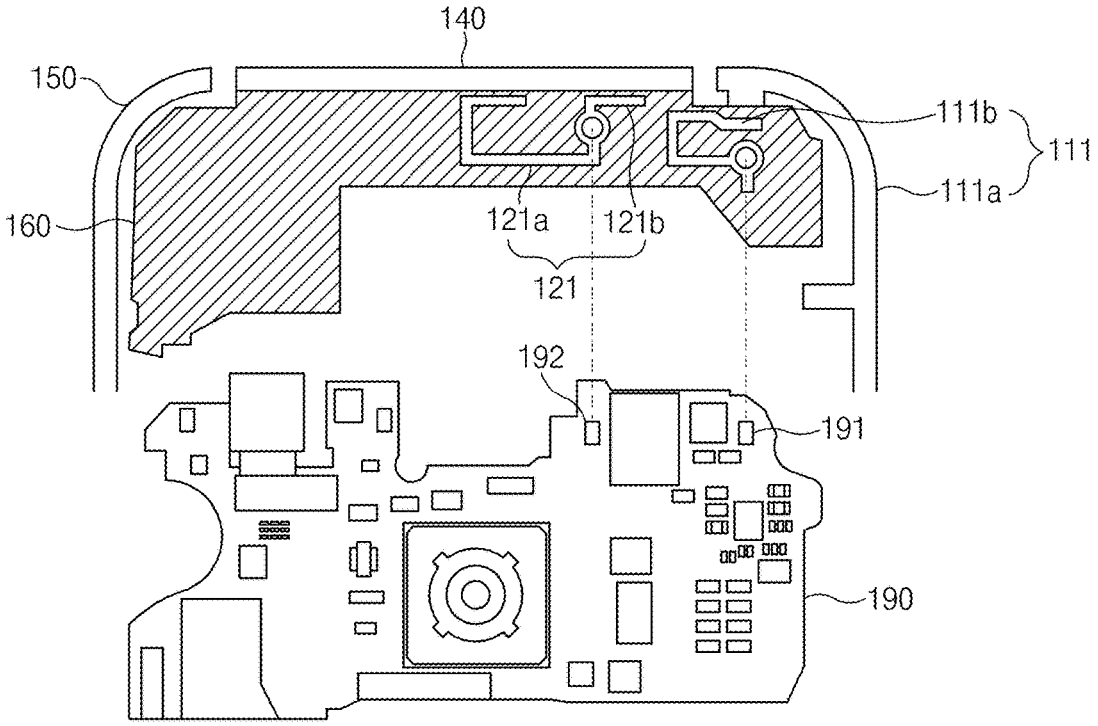

FIGS. 2A and 2B illustrate an example structure of an antenna included in an electronic device according to an embodiment of the present disclosure.

Referring to FIG. 2A, an electronic device according to an embodiment may include the first antenna radiator 111 including a first metal frame 111*a* and a conductive pattern 111*b*. the first feeding unit 112, the first ground unit 113, the second antenna radiator 121 including a first pattern 121*a*, and a second pattern 121*b*, a second metal frame 140, a third metal frame 150, and a support member 160. The electronic device may include a first surface facing a first direction, a second surface facing a second direction opposite to the first direction, and a side surface surrounding at least a part of a space between the first surface and the second surface.

The first antenna radiator 111 may include the first metal frame 111*a*, which is a part of the metal frames 111*a*, 140 and 150, and the conductive pattern 111*b* electrically connected to the first metal frame 111*a*.

The first metal frame (or the first conductive member) 111*a* may define a first part of the side surface of the electronic device and may have a first end. The first metal frame 111*a* may extend lengthily along the side surface of the electronic device. For example, the first metal frame 111*a* may be arranged on a right end of the electronic device. The first metal frame 111*a* may be a part of a side surface of a housing of the electronic device. The first metal frame 111*a* may be spaced apart from the second metal frame 140. An insulating member may be interposed between the first metal frame 111*a* and the second metal frame 140. The first metal frame 111*a* may include one or more flanges. The flange of the first metal frames 111*a* may be electrically connected to the first feeding unit 112 and the first ground unit 113, respectively.

Part B of the first metal frame 111*a* and part A of the conductive pattern 111*b* may be electrically connected to each other. For example, the first metal frame 111*a* and the conductive pattern 111*b* may be electrically connected to each other through a conductive member such as a C-clip.

The conductive pattern (or a first conductive pattern) 111*b* may be formed on the support member 160. The conductive pattern 111*b* may be arranged inside of the housing of the electronic device to be closer to the first metal frame 111*a* than the second metal frame 140. When the support member 160 is coupled at a specific position, the conductive pattern 111*b* may be electrically connected to the first metal frame 111*a*. The conductive pattern 111*b* may be arranged below a black matrix area of a display included in the electronic device.

The first antenna radiator 111 may be configured to transmit or receive a Wi-Fi signal of 2.4 GHz or 5 GHz. According to an embodiment, the first antenna radiator 111 may be configured to have a resonance frequency higher than a frequency in the first frequency band. Due to the limitation in the size of the electronic device, when a target frequency is low, the first antenna radiator 111 may have a resonance frequency higher than the target frequency. For example, when the first antenna radiator 111 is intended to transmit and receive a Wi-Fi signal, the first antennal radiator 111 may be configured to have resonance frequencies of about 2.6 GHz and about 5 GHz. The first antenna radiator 111 may be configured to transmit and receive various signals such as a cellular signal, a Bluetooth signal, a GPS signal, an NFC signal, an MST signal, and the like, as well as the Wi-Fi signal.

The second antenna radiator (or the second conductive pattern) 121 may include the first pattern 121*a* and the second pattern 121*b*. The second antenna radiator 121 may be arranged to be adjacent to the conductive pattern 111*b* such that the second antenna radiator 121 is coupled to the first antenna radiator 111. The second antenna radiator 121 may be formed on the support member 160. When the support member 160 is coupled at the specific position, the second antenna radiator 121 may be electrically connected to the second feeding unit and the second ground unit (not shown) through part C. The first pattern 121*a* and the second pattern 121*b* may be arranged below the black matrix area of the display.

The second antenna radiator 121 may be configured to transmit or receive a Wi-Fi signal of 5 GHz. The second antenna radiator 121 may be configured to transmit and receive various signals such as a cellular signal, a Bluetooth signal, a GPS signal, an NFC signal, an MST signal, and the like, as well as the Wi-Fi signal. The second antenna radiator 121 may be coupled with the second metal frame 140 configured to transmit or receive a Wi-Fi signal of 2.4 GHz. The resonance frequency of the second antenna radiator 121 may be higher or lower than 5 GHz. The resonance frequency of the second antenna radiator 121 may be changed into 5 GHz by coupling with the second metal frame 140.

The second antenna radiator 121 may include a conductive part (the first pattern 121*a*) elongated to be adjacent to the second metal frame 140. The first pattern 121*a* may have an electrical length corresponding to the first frequency band. The first pattern 121*a* may be coupled with the conductive pattern 111*b*. For example, the first pattern 121*a* may be formed in a C-shape. The first pattern 121*a* may extend in a direction opposite to that of the second metal frame 140 to be longer than the second metal frame 140, so that the first pattern 121*a* is adjacent to the second metal frame 140. The first pattern 121*a* may exert an influence on the characteristics of the first antenna radiator 111 in the first frequency band. According to an embodiment, the first pattern 121*a* may exert an influence on the resonance frequency of the first antenna radiator 111 in the first frequency band. For example, when the resonance frequency of the first antenna radiator 111 is 2.6 GHz and the first pattern 121*a* and the first antenna radiator 111 are coupled with each other, the resonance frequency of the first antenna radiator 111 may be changed into 2.4 GHz. The first pattern 121*a* may transmit or receive a signal of the first frequency band. Alternatively, the first pattern 121*a* may be arranged to change the characteristics of the first antenna radiator 111 without transmitting or receiving a signal.

The second pattern 121*b* may have an electrical length corresponding to the second frequency band. The second pattern 121*b* may extend in a direction different from that of the first pattern 121*a*. For example, the second pattern 121*b* may be formed in an L shape. The second pattern 121*b* may transmit or receive a signal of the second frequency band.

The second metal frame (or the second conductive member) 140 may define a second part of the side surface of the electronic device and may have a second end adjacent to the first end of the first metal frame 111*a*. A non-conductive member (not shown) may be inserted between the first metal frame 111*a* and the second metal frame 140. The second metal frame 140 may be elongated along the side surface of the electronic device. The second metal frame 140 may be arranged on an upper end or a lower end of the electronic device. The third metal frame 150 may be arranged on a left end of the electronic device. The second metal frame 140 and the third metal frame 150 may be parts of the side housing of the electronic device. The second metal frame 140 and/or the third metal frame 150 may serve as an antenna radiator. The second metal frame 140 may be configured to transmit or receive a signal of 2.4 GHz.

Referring to FIG. 2B, the support member 160 may be coupled at specific positions on the first metal frame 111*a*, the second metal frame 140 and the third metal frame 150. When the support member 160 is coupled at the specific position, the first metal frame 111*a* and the conductive pattern 111*b* may be electrically connected to each other through a conductive member such as a C-clip. A circuit board 190 may be arranged below the support member 160. The circuit board 190 may include (communication) ports 191 and 192 which may serve as the feeding unit. For example, the (communication) ports 191 and 192 may be electrically connected to the antenna radiators 111 and 121 formed on the support member 160 through a conductive member such as a C-clip. For example, a first port 191 may feed electric power to the first antenna radiator 111, and a second port 192 may feed electric power to the second antenna radiator 121. The first port 191 and the second port 192 may be electrically connected to an RF circuit (e.g., the RF circuit 170 of FIG. 4).

Figure 3A:
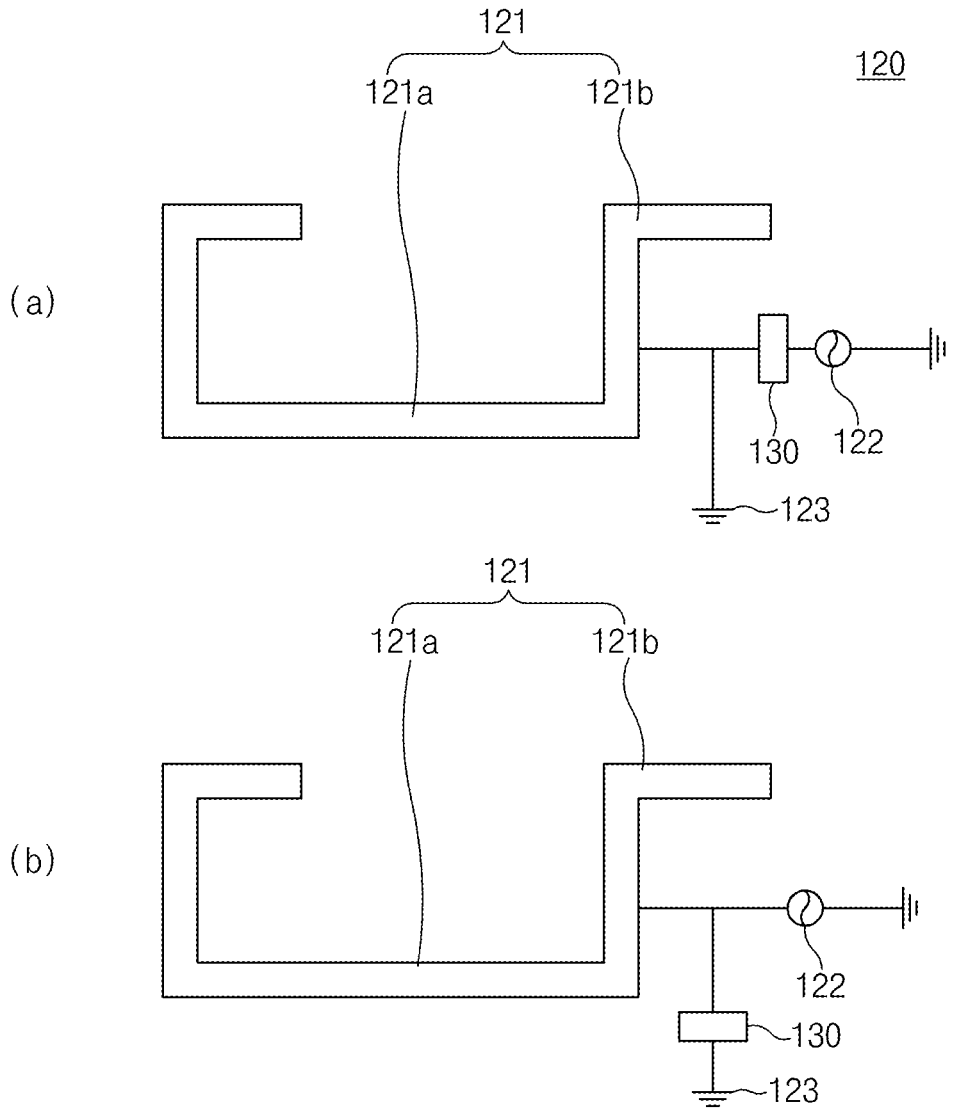
FIGS. 3A to 3C illustrate an example structure of an antenna included in an electronic device according to an embodiment of the present disclosure.
Figure 3B:
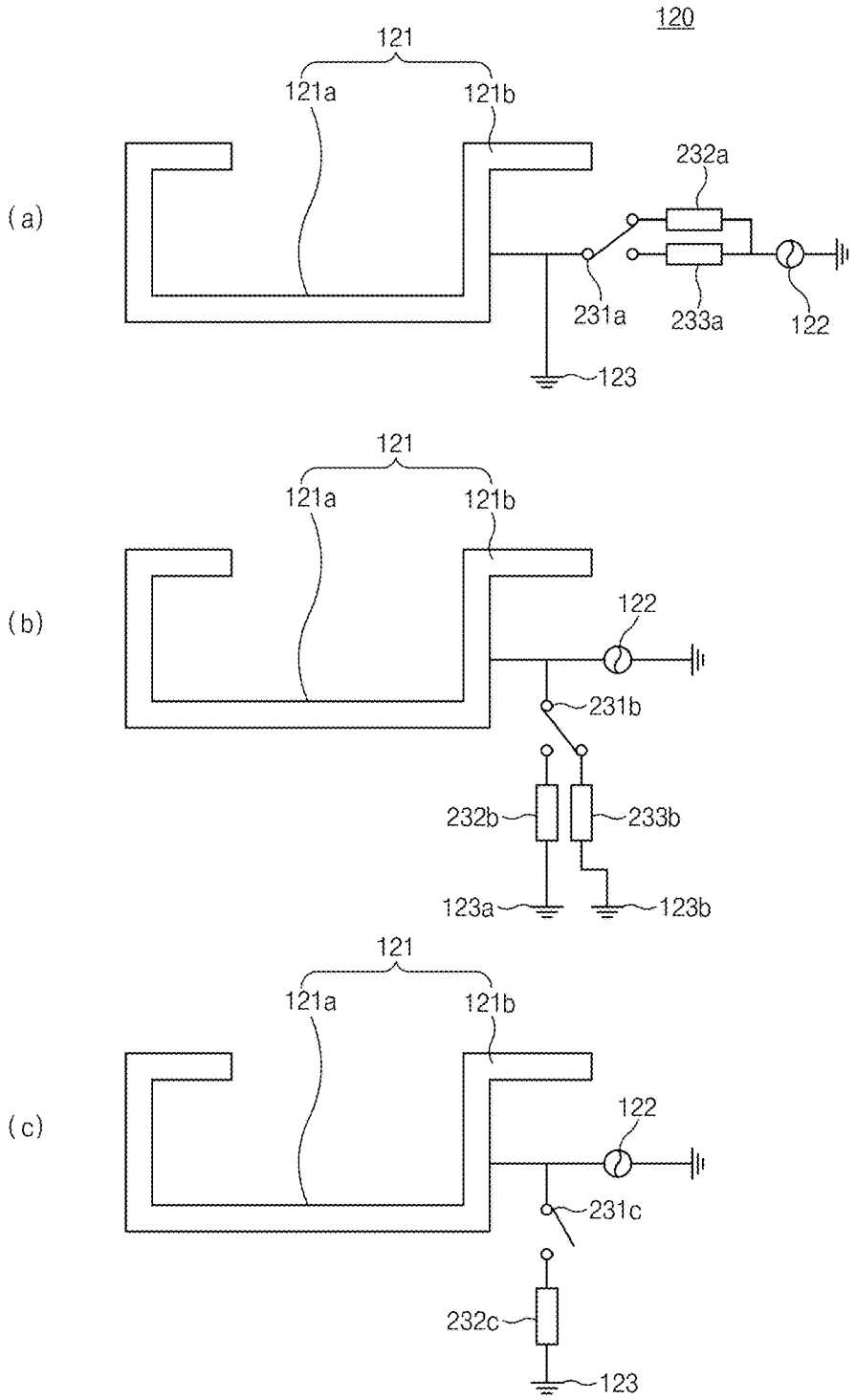
Figure 3C:
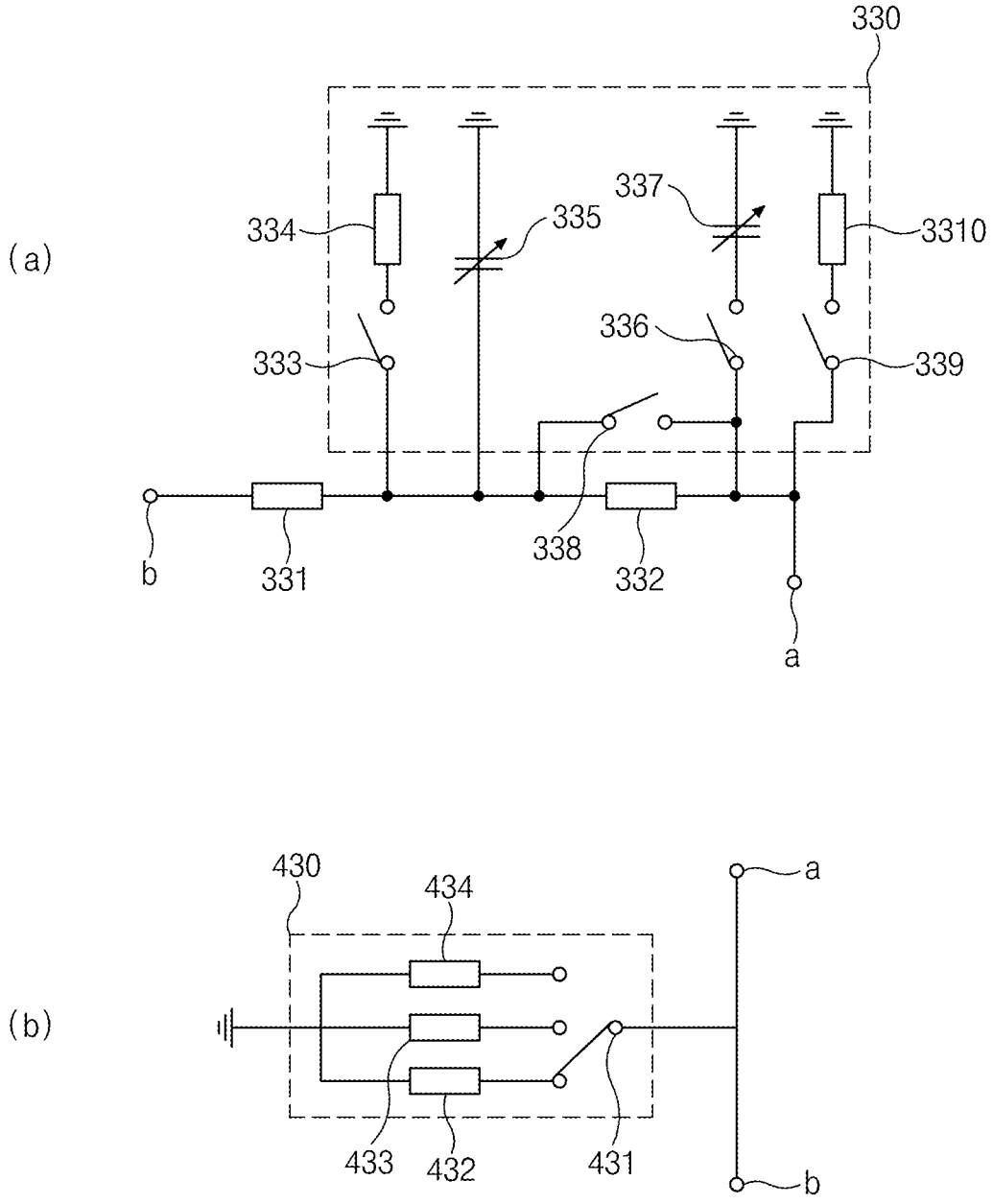

FIGS. 3A to 3C illustrate an example structure of an antenna included in an electronic device according to an embodiment of the present disclosure.

Referring to FIG. 3A, an electronic device may include the second antenna 120. The second antenna 120 may include the second antenna radiator 121 including the first pattern 121*a* and the second pattern 121*b*, the second feeding unit 122, the second ground unit 123, and the matching circuit 130.

The second antenna radiator 121 may be electrically connected to the second feeding unit 122 and the second ground unit 123. The second antenna radiator 121 may be connected to the second feeding unit 122 and the second ground unit 123 through part C depicted in FIG. 2.

The matching circuit 130 may be electrically connected to the second antenna radiator 121. As shown in FIG. 3, the matching circuit 130 may be arranged on a path in which the second antenna radiator 121 and the second feeding unit 122 are connected to each other, or a path in which the second antenna radiator 121 and the second ground unit 123 are connected to each other. Although not shown in FIG. 3, the matching circuit 130 may be arranged at a position at which the second antenna radiator 121, the second feeding unit 122, and the second ground unit 123 meet each other.

According to an embodiment, the matching circuit 130 may be configured to be mismatched with the second antenna radiator 121 in the first frequency band and to be matched with the second antenna radiator 121 in the second frequency band. The matching circuit 130 may be tuned to be matched with the second antenna radiator 121 in the first frequency band and to be matched with the second antenna radiator 121 in the second frequency band. The matching circuit 130 may have fixed impedance. In this case, the second antenna radiator 121 fails to transmit a signal of the first frequency band and may transmit and receive a signal of the second frequency band. The second antenna radiator 121 may transmit and receive a signal of the second frequency band together with the first antenna radiator 111 (e.g., the first antenna radiator 111 in FIGS. 1 and 2). The second antenna 121 may be in an idle state while the first antenna radiator transmits and/or receives a signal of the first frequency hand. Even if the matching circuit 130 is mismatched with the second antenna radiator 121 in the first frequency band, the first pattern 121*a* may exert an influence on the characteristics of the first antenna radiator in the first frequency band.

According to an embodiment, the matching circuit 130 may be a tuning circuit. For example, the matching circuit 130 may include at least one or more of a switch, a tuner, or a variable capacitor. In a case that the matching circuit 130 includes the switch, the switch included in the matching circuit 130 may be controlled to be switched off or on. When the matching circuit 130 includes the tuner, the impedance of the tuner included in the matching circuit 130 may be controlled. When the matching circuit 130 includes the variable capacitor, the capacitance of the variable capacitor included in the matching circuit 130 may be controlled.

According to an embodiment, when a signal of the first frequency band is transmitted or received through the first antenna radiator in the SISO mode, the matching circuit 130 may be controlled such that the second antenna radiator 121 is controlled to be mismatched in the first frequency band and to be matched in the second frequency band. When a signal of the first frequency band is transmitted or received through the first antenna radiator in the SISO mode, the first pattern 121*a* having the electric length corresponding to the first frequency band may prevent the first antenna radiator from transmitting or receiving the signal. Thus, the impedance of the match circuit 130 may be tuned to allow the second antenna radiator 121 to be mismatched in the first frequency band.

According to an embodiment, the matching circuit 130 may be controlled such that the bandwidth or efficiency of the first antenna radiator is increased in the first frequency band. The first pattern 121*a* having the electrical length corresponding to the first frequency band may exert an influence on the bandwidth or efficiency of the first antenna radiator in the first frequency band. In this case, the influence of the first pattern 121*a* on the first antenna radiator may be changed by the impedance of the matching circuit 130. Thus, the impedance of the matching circuit 130 may be tuned to increase the bandwidth or efficiency of the first antenna radiator in the first frequency band.

According to an embodiment, when a signal of the first frequency band is transmitted or received through the first antenna radiator and the second antenna radiator in the MIMO mode, the matching circuit 130 may be controlled such that the second antenna radiator 121 is matched in the first frequency band. If the second antenna radiator 121 is not matched in the first frequency band, the signal of the first frequency band may not be transmitted or received through the second antenna radiator 121. Thus, when a signal of the first frequency band or a signal of the second frequency band is transmitted or received through both the first antenna radiator and the second antenna radiator in the MIMO mode, the matching circuit 130 may be tuned such that the second antenna radiator is matched in the first frequency band.

Referring to FIG. 3B, the matching circuit 130 of FIG. 3A may include at least one circuit device or more.

For example, referring to (a) of FIG. 3B, the matching circuit 130 may be arranged on a connecting path between the second antenna radiator 121 and the second feeding unit 122 to each other. The matching circuit 130 may include a switch 231*a*, a first device 232*a*, and a second device 233*a*.

The first device 232*a* and the second device 233*a* may have mutually different impedances. The first device 232*a* and the second device 233*a* may have resistance components, inductance components, and/or capacitance components. The first device 232*a* and the second device 233*a* may include variable resistors, variable inductors, and/or variable capacitors. The variations in the resistance components, the inductance components, and/or the capacitance components of the first device 232*a* and the second device 233*a* may exert influences on the bandwidths or efficiencies of the second antenna radiator 121 and/or the antenna radiator (e.g., the first antenna radiator 111 of FIG. 2A) coupled with the second antenna radiator 121.

The switch 231*a* may selectively connect the second antenna radiator 121 to the first device 232*a* or the second device 233*a*. As the switch 231*a* operates, the resonance frequency of the second antenna radiator 121 may be changed. For example, when the second antenna radiator 121 is connected to the first device 232*a*, the second antenna radiator 121 is matched in the first frequency band. When the second antenna radiator 121 is connected to the second device 233*a*, the second antenna radiator 121 may be mismatched in the first frequency band.

As another example, referring to (b) of FIG. 3B, the matching circuit 130 may be arranged on the path of connecting the second antenna radiator 121 and the second ground unit 123*a* or 123*b* to each other. The matching circuit 130 may include a switch 231*b*, a first device 232*h*, and a second device 233*b*. The configurations of the switch 231*b*, the first device 232*b*, and the second device 233*b* may be the same as those of the switch 231*a*, the first device 232*a*, and the second device 233*a*, respectively.

As still another example, referring to (c) of FIG. 3B, the matching circuit 130 may be arranged on the path of connecting the second antenna radiator 121 and the second ground unit 123 to each other. The matching circuit 130 may include a switch 231*c* and a device 232*c*.

The device 232*c* may have impedance. The device 232*c* may include have a resistance component, an inductance component, and/or a capacitance component. The device 233*c* may include a variable resistor, a variable inductor, and/or a variable capacitor. The variations in the resistance component, the inductance component, and/or the capacitance component of the device 233*c* may exert influences on the bandwidths or efficiencies of the second antenna radiator 121 and/or the antenna radiator (e.g., the first antenna radiator 111 of FIG. 2A) coupled with the second antenna radiator 121.

The switch 231*c* may electrically connect the second antenna radiator 121 to the device 232*c*. As the switch 231*c* operates, the resonance frequency of the second antenna radiator 121 may be changed. For example, when the second antenna radiator 121 is connected to the device 232*c*, the second antenna radiator 121 is mismatched in the first frequency band. When the second antenna radiator 121 is connected to the device 233*c*, the second antenna radiator 121 may be matched in the first frequency band.

Referring to FIG. 3C, the matching circuit may include a plurality of circuit devices.

For example, referring to (a) of FIG. 3C, the matching circuit 330 may include four devices 331, 332, 334 and 3310, four switches 333, 336, 338 and 339, and two variable capacitors 335 and 337. Each of the four devices 331, 332, 334 and 3310 may include a resistance component, an inductance component, and/or a capacitance component. The four switches 333, 336, 338 and 339 may switch on or off circuits. The capacitances of the two variable capacitors 335 and 337 may vary. For example, node 'a' may be connected to the second antenna radiator 121 of FIG. 3A, and node 'b' may be connected to the second feeding unit 122 or the second ground unit 123. As another example, node 'b' may be connected to the second antenna radiator 121 of FIG. 3A, and node 'a' may be connected to the second feeding unit 122 or the second ground unit 123.

The first device 331 and the second device 332 may be connected in series to each other between node 'a' and node 'b'. The first switch 333 may be connected in parallel to the first device 331 and the second device 332 between the first device 331 and the second device 332. The third device 334 may be connected in series to the first switch 333. The first variable capacitor 335 may be connected in parallel to the first device 331 and the second device 332 between the first device 331 and the second device 332. The second switch 336 may be connected in parallel to the second device between node 'a' and the second device 332. The second variable capacitor 337 may be connected in series to the second switch 336. The third switch 338 may be connected in parallel to the second device 332 and may be connected to one terminal of the second switch 336. The fourth switch 339 may be connected in parallel to the second device 332 between node 'a' and the second device 332. The fourth device 3310 may be connected in series to the fourth switch 339.

The operations of the four switches 333, 336, 338 and 339 or the variations in the capacitances of the two capacitors 335 and 337 may exert influences on the bandwidths or efficiencies of the second antenna radiator 121 and/or the antenna radiator (e.g., the first antenna radiator 111 of FIG. 2A) coupled with the second antenna radiator 121. In addition, the operations of the four switches 333, 336, 338 and 339 or the variations in the capacitances of the two capacitors 335 and 337 may exert an influence on the resonance frequency of the second antenna radiator 121.

As another example, referring to (b) of FIG. 3C, the matching circuit 430 may include a switch 431 and three devices 432, 433 and 434. The switch 431 may switch on or off a circuit. Each of the three devices 432, 433 and 434 may include a resistance component, an inductance component, and/or a capacitance component. For example, node 'a' may be connected the second antenna radiator 121 of FIG. 3A, and node 'b' may be connected to the second feeding unit 122 or the second ground unit 123 of FIG. 3A. As another example, node 'b' may be connected to the second antenna radiator 121 of FIG. 3A, and node 'a' may be connected to the second feeding unit 122 or the second ground unit 123 of FIG. 3A.

The switch 431 may be connected to node 'a' and node 'b'. The first device 432, the second device 433, and the third device 434 may be connected in parallel to each other. One ends of the first device 432, the second device 433, and the third device 434 may be connected to the switch 431, and other ends of the first device 432, the second device 433, and the third device 434 may be connected to the ground unit. As the switch 431 is operated, the first device 432, the second device 433, and the third device 434 may be selectively connected to the node 'a' and node 'b'.

The operation of the switch 431 may exert an influence on the bandwidths or efficiencies of the second antenna radiator 121 and/or the antenna radiator (e.g., the first antenna radiator 111 of FIG. 2A) coupled with the second antenna radiator 121. In addition the operation of the switch 431 may exert an influence on a resonance frequency of the second radiator 121.

Figure 4:
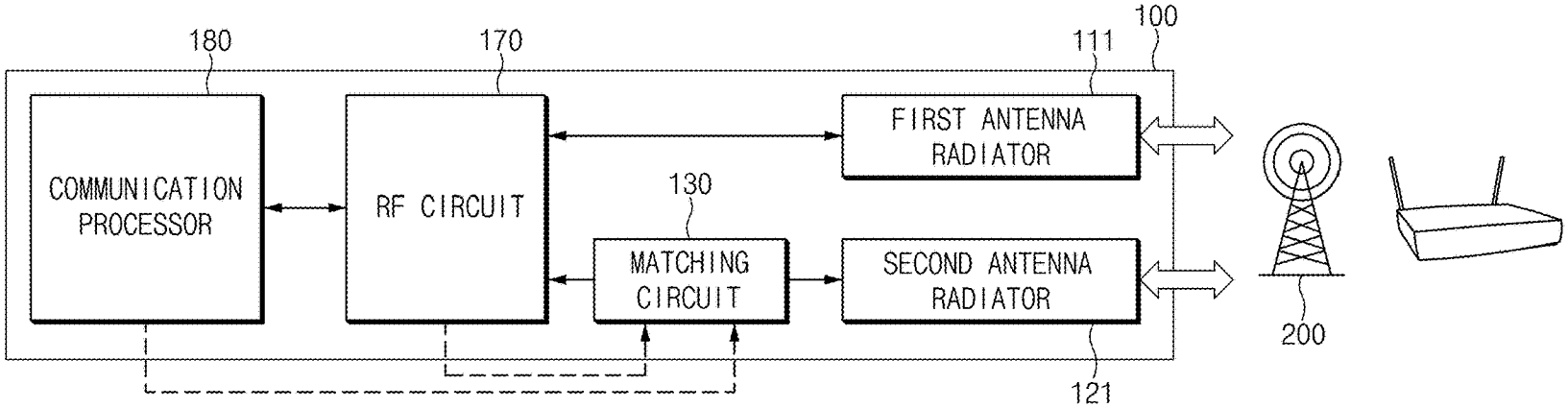
FIG. 4 illustrates an example configuration of an electronic device according to an embodiment of the present disclosure.

FIG. 4 illustrates an example configuration of an electronic device according to an embodiment of the present disclosure.

Referring to FIG. 4, an electronic device 100 may include the first antenna radiator 111, the second antenna radiator 121, a radio frequency (RF) circuit, and a communication processor 180.

The first antenna radiator 111 and the second antenna radiator 121 may transmit and receive a signal to and from a repeater 200. The first antenna radiator 111 and the second antenna radiator 121 may transmit and receive a signal to and from a (MIMO) repeater 200 or a (SISO) repeater 200. For example, the repeater 200 may be one of various repeaters 200 such as a base station, a Wi-Fi access point, and the like.

The matching circuit may be electrically connected to the second antenna radiator 121. The matching circuit may be a device having a fixed impedance or a device, such as a switch, a tuner, a variable capacitor, and the like, which may be controlled by the communication processor 180.

The RF circuit 170 may be a wireless communication circuit. The RF circuit 170 may include a Wi-Fi communication circuit supporting the 2.4 GHz band and the 5 GHz band.

The RF circuit 170 may be electrically connected to the first antenna radiator 111 and the second antenna radiator 121. The RF circuit 170 may be connected to the second antenna radiator 121 through the matching circuit. Although not shown in FIG. 4, a matching circuit for the first antenna radiator 111 may be provided between the RF circuit 170 and the first antenna radiator 111.

The RF circuit 170 may transmit a control signal for controlling the matching circuit 130 to the matching circuit 130. For example, the RF circuit 170 may transmit a signal for controlling a switch included in the matching circuit 130 to the matching circuit 130.

The RF circuit 170 may transmit and receive a signal through the first antenna radiator 111 and/or the second antenna radiator 121. For example, the RF circuit 170 may electrically connected to the first metal frame 111*a* and the conductive pattern 111*b* to transmit and/or receive a signal of a first frequency (e.g., 2.4 GHz). As another example, the RF circuit 170 may be electrically connected to the conductive pattern 111*b* and/or the second antenna radiator 121 to transmit and/or receive a signal of a second frequency (e.g., 5 GHz) higher than the first frequency. The signal processed by the RF circuit 170 may be radiated through the first antenna radiator 111 and/or the second antenna radiator 212 to an outside. The RF circuit 170 may receive a signal from an outside through the first antenna radiator 111 and/or the second antenna radiator 121.

The communication processor 180 may be electrically connected to the RF circuit 170. The communication processor 180 may control the RF circuit 170. The communication processor 180 may control the matching circuit 130. The communication processor 180 may transmit a control signal to the matching circuit 130 to control the match circuit 130. For example, the communication processor 180 may transmit a signal for controlling the switch included in the matching circuit 130 to the matching circuit 130.

According to an embodiment, the communication processor 180 may control the RF circuit 170 such that a signal of the first frequency band or the second frequency band is transmitted or received through the first antenna radiator 111 and the second antenna radiator 121 in the MIMO mode. For example, when the communication with the repeater 200 is in a smooth state or the traffic of the repeater 200 is low, the communication processor 180 may control the RF circuit 170 such that the signal is transmitted and/or received to and from the repeater 200 in the MIMO mode.

According to an embodiment, the communication processor 180 may control the RF circuit 170 such that a signal of the first frequency band or the second frequency band is transmitted or received through the first antenna radiator 111 in the SISO mode. For example, when the communication state with the repeater 200 is not smooth or the traffic of the repeater 200 is high, the communication processor 180 may control the RF circuit 170 such that the signal is transmitted and/or received to and from the repeater 200 in the SISO mode.

According to an embodiment, when the RF circuit 170 transmits or receives a signal of the first frequency band through the first antenna radiator 111 and the second antenna radiator 121 in the MIMO mode, the communication processor 180 may control the matching circuit such that the second antenna radiator 121 is matched in the first frequency band. When the second antenna radiator 121 is not matched in the first frequency band, the signal of the first frequency band may be transmitted or received through the second antenna radiator 121. Thus, when the signal of the first frequency band is transmitted or received in the MIMO mode, the communication processor 180 may tune the matching circuit such that the second antenna radiator 121 is matched in the first frequency band. For example, the communication processor 180 may tune the matching circuit to allow the match circuit to have specific impedance such that the matching circuit is matched together with the second antenna radiator 121 in the first frequency band.

According to an embodiment, when the RF circuit 170 transmits or receives a signal of the first frequency band through the first antenna radiator 111 in the SISO mode, the communication processor 180 may control the matching circuit such that the second antenna radiator 121 is mismatched in the first frequency band. When the signal of the first frequency band is transmitted and/or received through the first antenna radiator 111 in the SISO mode, the transmission or reception through a pattern (e.g., the first pattern 121*a* of FIG. 3) having an electrical length, which corresponds to the first frequency band and is included in the second antenna radiator 121, may be obstructed. Thus, when the signal of the first frequency band is transmitted or received through the first antenna radiator 111 in the SISO mode, the communication processor 180 may tune the matching circuit such that the second antenna radiator 121 is mismatched in the first frequency band. For example, the communication processor 180 may tune the matching circuit to allow the match circuit to have specific impedance such that the match circuit is mismatched together with the second antenna radiator 121 in the first frequency band.

According to an embodiment, when a signal of the first frequency band is transmitted or received through the first antenna radiator 111 in the SISO mode, the communication processor 180 may control the matching circuit such that the resonance frequency of the first antenna radiator 111 is changed. The first antenna radiator 111 may have a resonance frequency higher than a target resonance frequency due to the limitation to the size of the electronic device 100. The pattern (e.g., the first pattern 121*a* of FIG. 3) included in the second antenna radiator 121 and the matching circuit may exert an influence on the resonance frequency of the first antenna radiator 111 when being coupled with the first antenna radiator 111. The communication processor 180 may tune the matching circuit to allow the matching circuit to have specific impedance such that the resonance frequency of the first antenna radiator 111 is reduced. For example, when the first antenna radiator 111 transmitting and/or receiving a Wi-Fi signal has a resonance frequency of about 2.6 GHz, the communication processor 180 may tune the matching circuit such that the resonance frequency of the first antenna radiator 111 is changed to about 2.4 GHz.

According to an embodiment, the communication processor 180 may control the RF circuit 170 based on information about a communication state received from the repeater 200 communicating with the electronic device 100, such that a signal of the first frequency band is transmitted or received through at least one or more of the first antenna radiator 111 or the second antenna radiator 121 in the MIMO mode or the SISO mode. A method of controlling the RF circuit 170 based on the information about the communication state will be described in detail with reference to FIG. 6.

Figure 5:
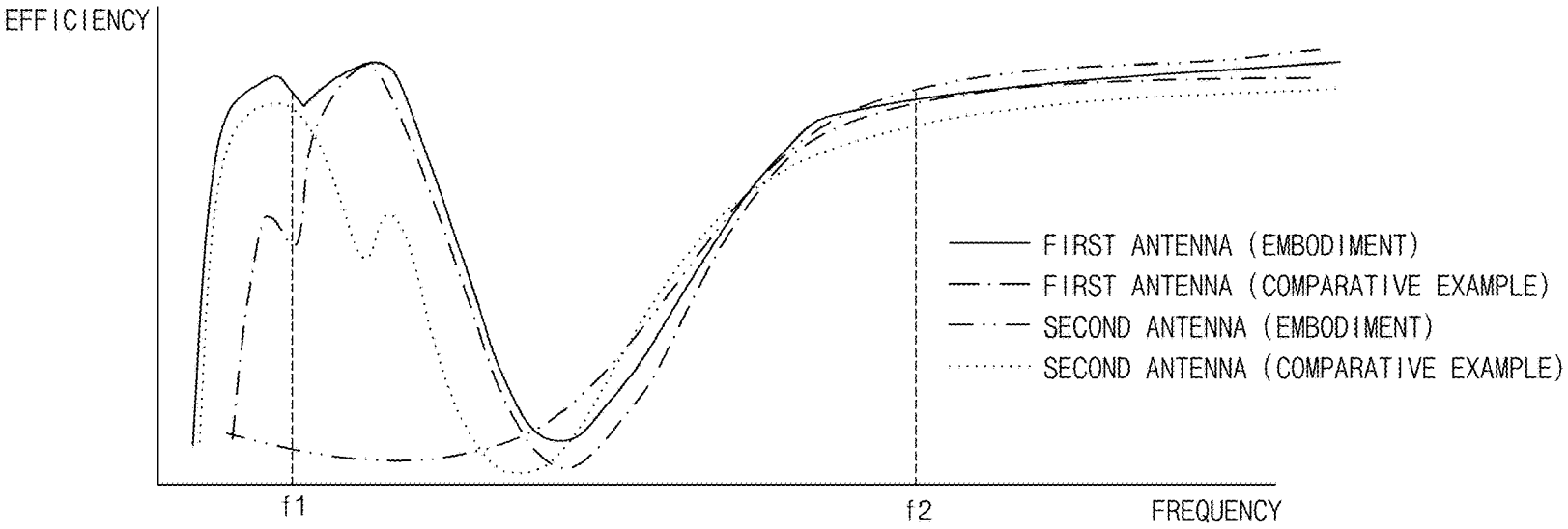
FIG. 5 illustrates an example graph of efficiency of an antenna included in an electronic device over frequency over frequency according to an embodiment of the present disclosure.

FIG. 5 illustrates an example graph of efficiency over frequency of an antenna included in an electronic device according to an embodiment of the present disclosure.

The graph illustrates the efficiencies of a first antenna and a second antenna according to a comparative example and the efficiencies of a first antenna (e.g., the first antenna 110) and a second antenna (e.g., the second antenna 120) according to an embodiment. The efficiencies of the antenna according to the comparative example to a first frequency f1 and a second frequency f2, and the efficiencies of the antenna according to an embodiment to the first frequency f1 and the second frequency f2 may be confirmed through the graph. An electronic device according to a comparative example includes the second antenna impedance-matched to the first frequency f1. An electronic device (e.g., the electronic device 100) according to an embodiment includes the second antenna (e.g., the second antenna 120) impedance-mismatched to the first frequency f1.

Referring to FIG. 5, since the second antenna according to the comparative example is matched to the first frequency f1, the second antenna may have a resonance frequency corresponding to the first frequency f1. The first antenna according to the comparative example may have a resonance frequency higher than the first frequency f1. The first antenna according to the comparative example may have a low efficiency at the first frequency f1 due to the second antenna matched to the first frequency f1. Thus, when a signal of the first frequency f1 is transmitted and/or received through the first antenna according to a comparative example in the SISO mode, the communication efficiency may be low.

To the contrary, since the second antenna (e.g., the second antenna 120) according to an embodiment is mismatched to the first frequency f1, the second antenna may not resonate at the first frequency f1. Thus, the second antenna according to an embodiment may not transmit and receive a signal of the first frequency f1. Since the first antenna (e.g., the first antenna 110) according to an embodiment resonates at a low frequency compared to an electrical length of the first antenna due to the coupling with the second antenna, the first antenna may have a resonance frequency corresponding to the first frequency f1 and the bandwidth may be enlarged at the first frequency f1. Since the second antenna mismatched to the first frequency f1 does not obstruct the transmission and reception of the signal of the first frequency f1, the first antenna according to an embodiment may have a high efficiency at the first frequency f1.

Figure 6:
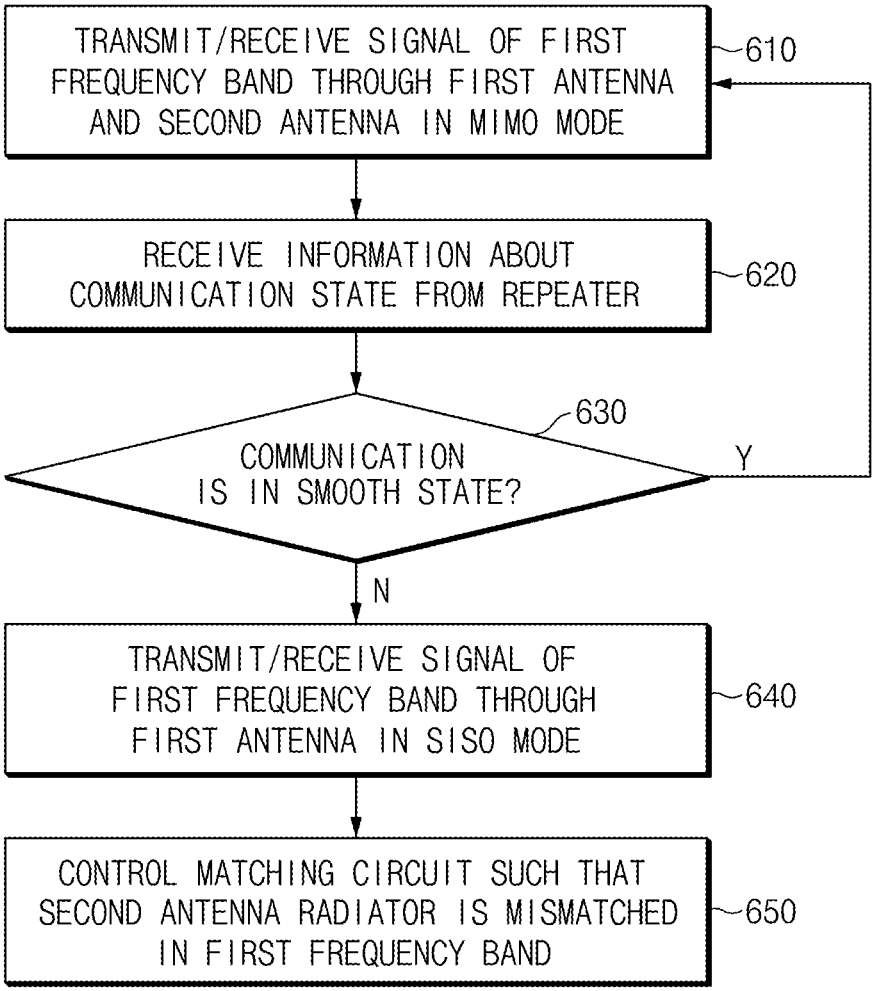
FIG. 6 illustrates a flowchart of a method for controlling an antenna of an electronic device according to an embodiment of the present disclosure.

FIG. 6 illustrates a flowchart a method for controlling an antenna of an electronic device according to an embodiment of the present disclosure.

The flowchart illustrated in FIG. 6 may include operations processed by the electronic device 100 depicted in FIGS. 1 to 4. Thus, even though omitted in the following description, the contents concerning the electronic device 100 described with reference to FIGS. 1 to 4 may be also applied to the flowchart illustrated in FIG. 6.

According to an embodiment, the electronic device (e.g., the communication processor 180) 100 may control the RF circuit based on the information about the communication information received from the repeater 200 communicating with the electronic device 100, such that the signal of the first frequency band is transmitted or received through at least one or more of the first antenna 110 or the second antenna 120 in the MIMO mode or the SISO mode.

Referring to FIG. 6, in operation 610, the electronic device (e.g., the communication processor 180) 100 may transmit or receive the signal of the first frequency band by using the first antenna 110 and the second antenna 120 in the MIMO mode. The electronic device 100 may transmit or receive the signal of the first frequency band through both the first antenna 110 and the second antenna 120 at the same time. In this case, the matching circuit 130 included in the electronic device 100 may be tuned such that the second antenna 120 is matched in the first frequency band. The electronic device 100 may transmit or receive the signal of the second frequency band through the first antenna 110 and the second antenna 120 in the MIMO mode.

In operation 620, the electronic device (e.g., the communication processor 180) 100 may receive the information about the communication state from the repeater 200. For example, the electronic device 100 may receive the information about the communication state through the first antenna 110 and/or the second antenna 120 from the repeater 200 such as a base station, a Wi-Fi access point, and the like. For example, the information about the communication state may include information, on the basis of which it is known whether the communication through the repeater 200 is smooth, such as information about the traffic of the repeater 200.

In operation 630, the electronic device (e.g., the communication processor 180) 100 may determine, based on the information about the communication state, whether the communication is in a smooth state. For example, when the traffic of the repeater 200 is greater than a specific value, the electronic device 100 may determine that the communication is heavy. When the traffic of the repeater 200 is less than the specific value, the electronic device 100 may determine that the communication is smooth. When it is determined that the communication is smooth, the electronic device 100 may transmit or receive a signal in the MIMO mode.

When the communication is heavy, the electronic device 100 (e.g., the communication processor 180) may transmit or receive a signal of the first frequency band through the first antenna 110 in the SISO mode in operation 640. When the electronic device 100 transmits or receives the signal of the first frequency band only through the first antenna 110, the second pattern included in the second antenna 120 may exert an influence on the first antenna 110. The electronic device 100 may perform operation 650 to prevent the second pattern included in the second antenna 120 from deteriorating the efficiency of the first antenna 110.

In operation 650, the electronic device the communication processor 180) 100 may control the matching circuit 130 such that the second antenna 120 is mismatched in the first frequency band. The electronic device 100 may tune the matching circuit 130 to allow the second antenna 120 to be mismatched in the first frequency band such that the second antenna 120 is prevented from exerting an influence on the transmission or reception of the signal of the first frequency band.

Although it is illustrated in FIG. 6 that the operation 650 is performed after the operation 640 is performed, the embodiment is not limited thereto, and the electronic device 100 may perform the operation 640 after performing the operation 650.

Figure 7:
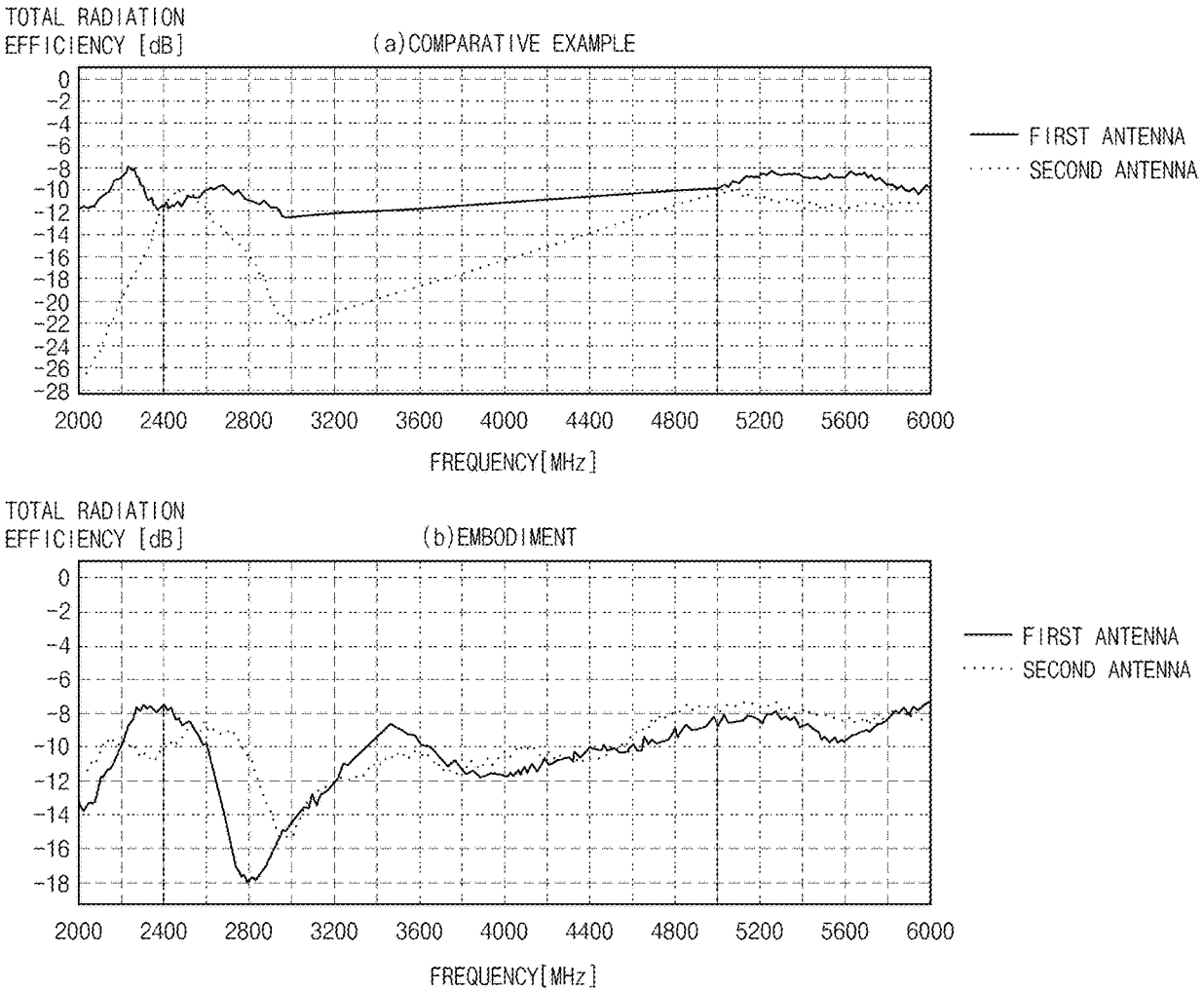
FIG. 7 illustrates an example graph of a total radiation efficiency over frequency of an antenna included in an electronic device according to an embodiment of the present disclosure.

FIG. 7 is a graph illustrating total radiation efficiency over frequency of an antenna included in an electronic device according to an embodiment.

A graph illustrated in (a) of FIG. 7 illustrates total radiation efficiencies over frequency of the first antenna and the second antenna included in an electronic device according to a comparative example. The electronic device according to a comparative example includes a second antenna of which impedance is matched to a frequency of 2400 MHz. The first antenna according to the comparative example may transmit and receive signals of 2400 MHz and 5000 MHz. The second antenna according to the comparative example may transmit and receive a signal of 5000 MHz.

Referring to (a) of FIG. 7, the first antenna according to the comparative example has the total radiation efficiency of about −12 dB at 2400 MHz. The second antenna according to the comparative example has the total radiation efficiency of about −12 dB at 2400 MHz. The first antenna, which has the total radiation efficiency of about −12 dB at 2400 MHz, may not efficiently transmit or receive a signal of 2400 MHz. Lower total radiation efficiency may be required to transmit or receive a signal of 2400 MHz through the first antenna.

A graph illustrated in (b) of FIG. 7 illustrates total radiation efficiencies over frequency of the first antenna (e.g., the first antenna 110) and the second antenna (e.g., the second antenna 120) included in an electronic device (e.g., the electronic device 100) according to an embodiment. The electronic device according to the embodiment includes the second antenna (e.g., the second antenna 120) of which an impedance is mismatched to a frequency of 2400 MHz. The first antenna according to the embodiment may transmit and receive a signal of 2400 MHz and 5000 MHz. The second antenna according to the embodiment may transmit and receive a signal of 5000 MHz.

Referring to (b) of FIG. 7, the first antenna according to the embodiment has the total radiation efficiency of about −8 dB at 2400 MHz. The second antenna according to the embodiment has the total radiation efficiency of about −10 dB at 2400 MHz. Since the impedance of the second antenna is mismatched at 2400 MHz, the total radiation efficiency of the first antenna may be improved by about 4 dB or more at 2400 MHz. The electronic device according to the embodiment may smoothly transmit or receive a signal of 2400 MHz through the first antenna of which the total radiation efficiency is improved.

Figure 8:
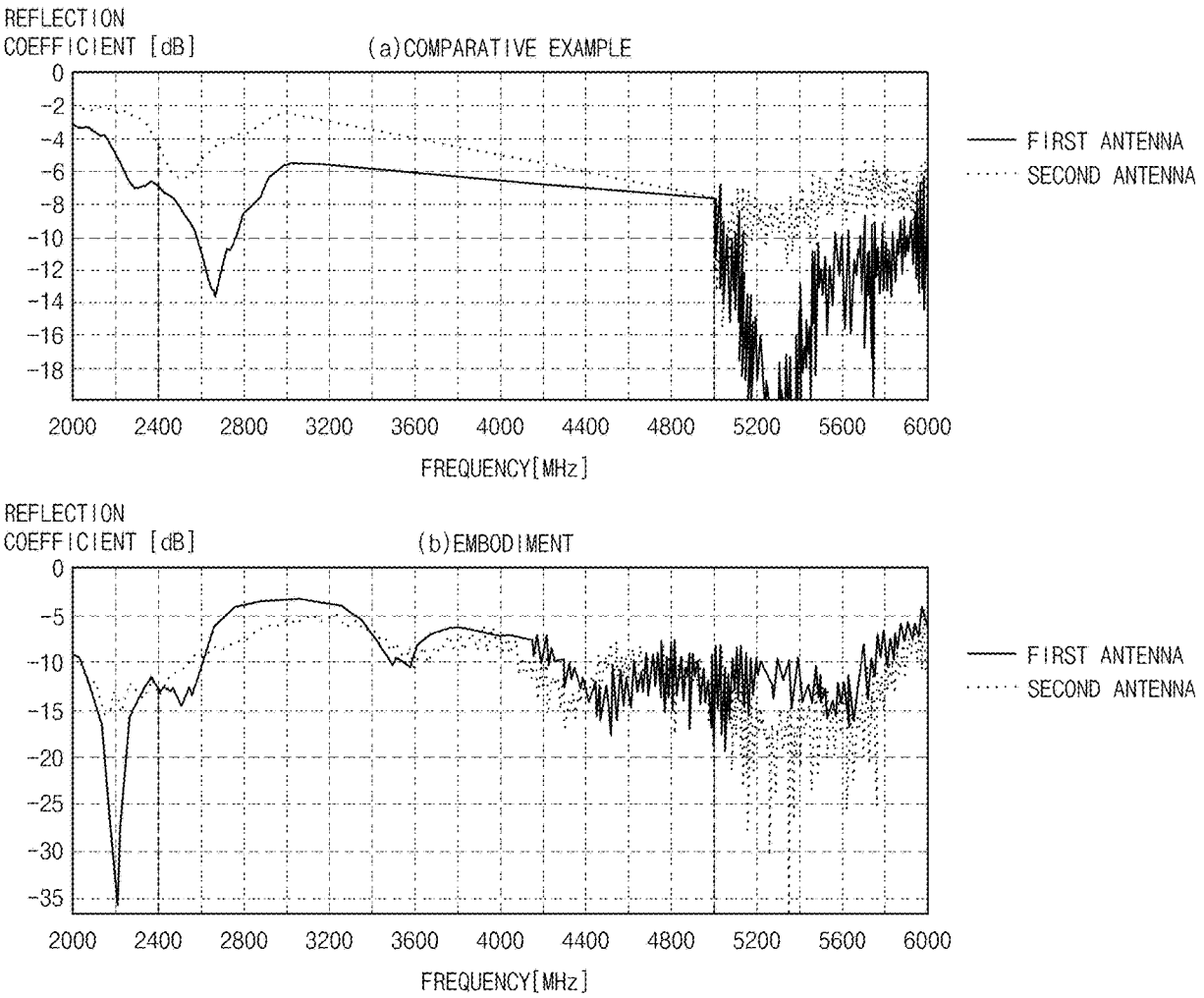
FIG. 8 illustrates an example graph of a reflection coefficient over frequency of an antenna included in an electronic device according to an embodiment of the present disclosure.

FIG. 8 illustrates an example graph of a reflection coefficient over frequency of an antenna included in an electronic device according to an embodiment of the present disclosure.

A graph illustrated in (a) of FIG. 8 illustrates the reflection coefficients over frequency of the first antenna and the second antenna included in an electronic device according to a comparative example. The electronic device according to a comparative example includes a second antenna of which impedance is matched to a frequency of 2400 MHz. The first antenna according to the comparative example may transmit and receive signals of 2400 MHz and 5000 MHz. The second antenna according to the comparative example may transmit and receive a signal of 5000 MHz.

Referring to (a) of FIG. 8, the first antenna according to the comparative example has a reflection coefficient of about −7 dB at 2400 MHz. The second antenna according, to the comparative example has a reflection coefficient of about −4 dB at 2400 MHz. The first antenna, which has the reflection coefficient of about −7 dB at 2400 MHz, may not efficiently transmit or receive a signal of 2400 MHz. A lower reflection coefficient may be required to transmit or receive a signal of 2400 MHz through the first antenna.

A graph illustrated in (b) of FIG. 8 illustrates the reflection coefficients over frequency of the first antenna (e.g., the first antenna 110) and the second antenna (e.g., the second antenna 120) included in an electronic device (e.g., the electronic device 100) according to an embodiment. The electronic device according to the embodiment includes the second antenna (e.g., the second antenna 120) of which an impedance is mismatched to a frequency of 2400 MHz. The first antenna according to the embodiment may transmit and receive signals of 2400 MHz and 5000 MHz. The second antenna according to the embodiment may transmit and receive a signal of 5000 MHz.

Referring to (b) of FIG. 8, the first antenna according to the embodiment has a reflection coefficient of about −13 dB at 2400 MHz. The second antenna according to the embodiment has a reflection coefficient of about −13 dB at 2400 MHz. Since the impedance of the second antenna is mismatched at 2400 MHz, the reflection coefficient of the first antenna may be lowered by about 6 dB or more at 2400 MHz. The electronic device according to the embodiment may smoothly transmit or receive a signal of 2400 MHz through the first antenna of which the reflection coefficient is lowered.

Figure 9:
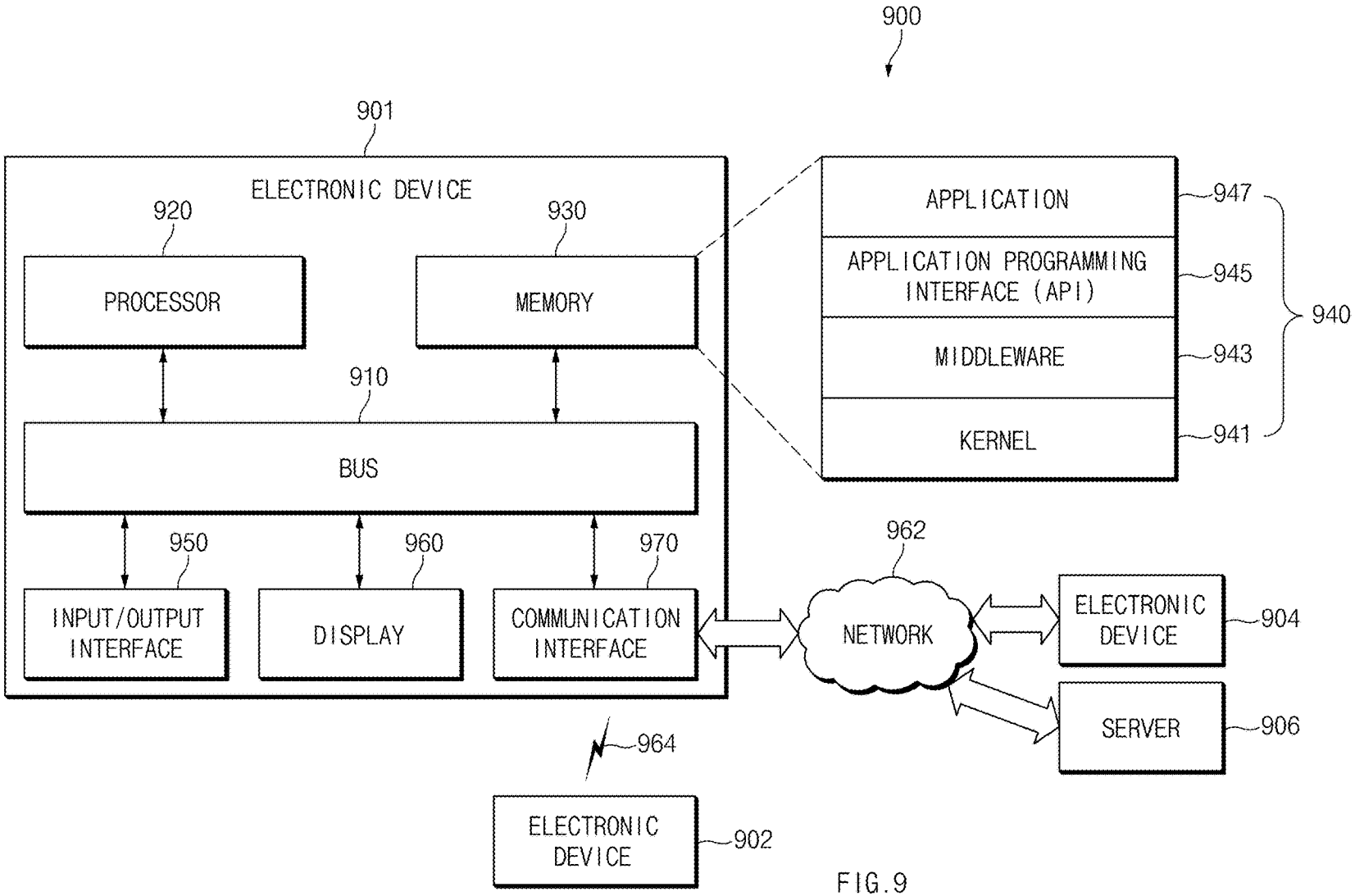
FIG. 9 illustrates an example an electronic device in network environment according to various embodiments of the present disclosure.

FIG. 9 illustrates an example electronic device in a network environment, according to various embodiments of the present disclosure.

Referring to FIG. 9, according to various embodiments, an electronic device 901, 902, or 904 or a server 906 may be connected with each other over a network 962 or a local area network 964. The electronic device 901 may include a bus 910, a processor 920, a memory 930, an input/output interface 950, a display 960, and a communication interface 970. According to an embodiment, the electronic device 901 may not include at least one or more of the above-described elements or may further include other element(s).

For example, the bus 910 may interconnect the above-described elements 910 to 970 and may be a circuit for conveying communications (e.g., a control message and/or data) among the above-described elements.

The processor 920 may include one or more of a central processing unit (CPU), an application processor (AP), or a communication processor (CP). For example, the processor 920 may perform an arithmetic operation or data processing associated with control and/or communication of at least other elements of the electronic device 901.

The memory 930 may include a volatile and/or nonvolatile memory. For example, the memory 930 may store instructions or data associated with at least one other element(s) of the electronic device 901. According to an embodiment, the memory 930 may store software and/or a program 940. The program 940 may include, for example, a kernel 941, a middleware 943, an application programming interface (API) 945, and/or an application program (or "an application") 947. At least a part of the kernel 941, the middleware 943, or the API 945 may be called an "operating system (OS)".

For example, the kernel 941 may control or manage system resources (e.g., the bus 910, the processor 920, the memory 930, and the like) that are used to execute operations or functions of other programs (e.g., the middleware 943, the API 945, and the application program 947). Furthermore, the kernel 941 may provide an interface that allows the middleware 943, the API 945, or the application program 947 to access discrete elements of the electronic device 901 so as to control or manage system resources.

The middleware 943 may perform a mediation role such that the API 945 or the application program 947 communicates with the kernel 941 to exchange data.

Furthermore, the middleware 943 may process task requests received from the application program 947 according to a priority. For example, the middleware 943 may assign the priority, which makes it possible to use a system resource (e.g., the bus 910, the processor 920, the memory 930, or the like) of the electronic device 901, to at least one or more of the application program 947. For example, the middleware 943 may process the one or more task requests according to the priority assigned to the at least one, which makes it possible to perform scheduling or load balancing on the one or more task requests.

The API 945 may be, for example, an interface through which the application program 947 controls a function provided by the kernel 941 or the middleware 943, and may include, for example, at least one interface or function (e.g., an instruction) for a file control, a window control, image processing, a character control, or the like.

The input/output interface 950 may play a role, for example, an interface which transmits an instruction or data input from a user or another external device, to other element(s) of the electronic device 901. Furthermore, the input/output interface 950 may output an instruction or data, received from other element(s) of the electronic device 901, to a user or another external device.

The display 960 may include, for example, a liquid crystal display (LCD), a light-emitting diode (LED) display, an organic LED (OLED) display, a microelectromechanical systems (MEMS) display, or an electronic paper display. The display 960 may display, for example, various contents (e.g., a text, an image, a video, an icon, a symbol, and the like) to a user. The display 960 may include a touch screen and may receive, for example, a touch, gesture, proximity, or hovering input using an electronic pen or a part of a user's body.

For example, the communication interface 970 may establish communication between the electronic device 901 and an external device (e.g., the first external electronic device 902, the second external electronic device 904, or the server 906). For example, the communication interface 970 may be connected to the network 962 over wireless communication or wired communication to communicate with the external device (e.g., the second external electronic device 904 or the server 906).

The wireless communication may include at least one or more of, for example, long-term evolution (LTE), LTE-A (LTE Advanced), code division multiple access (CDMA), wideband CDMA (WCDMA), universal mobile telecommunications system (UMTS), wireless broadband (WiBro), global system for mobile communications (GSM), or the like, as cellular communication protocol. Furthermore, the wireless communication may include, for example, the short range communication 964. The short range communication 964 may include at least one or more of a wireless fidelity (Wi-Fi), a Bluetooth, a near field communication (NFC), a magnetic stripe transmission (MST), a global navigation satellite system (GNSS), or the like.

The MST may generate a pulse in response to transmission data using an electromagnetic signal, and the pulse may generate a magnetic field signal. The electronic device 901 may transfer the magnetic field signal to point of sale (POS), and the POS may detect the magnetic field signal using a MST reader. The POS may recover the data by converting the detected magnetic field signal to an electrical signal.

The GNSS may include at least one or more of, for example, a global positioning system (GPS), a global navigation satellite system (Glonass), a Beidou navigation satellite system (hereinafter referred to as "Beidou"), or an European global satellite-based navigation system (hereinafter referred to as "Galileo") based on an available region, a bandwidth, or the like. Hereinafter, in the present disclosure, "GPS" and "GNSS" may be interchangeably used. The wired communication may include at least one or more of, for example, a universal serial bus (USB), a high definition multimedia interface (HDMI), a recommended standard-232 (RS-232), a plain old telephone service (POTS), or the like. The network 962 may include at least one or more of telecommunications networks, for example, a computer network (e.g., LAN or WAN), an Internet, or a telephone network.

Each of the first external electronic device 902 and the second external electronic device 904 may be a device of which the type is different from or the same as that of the electronic device 901. According to an embodiment, the server 906 may include a group of one or more servers. According to various embodiments, all or a part of operations that the electronic device 901 may perform may be executed by another or plural electronic devices (e.g., the electronic devices 902 and 904 or the server 906). According to an embodiment, in the case where the electronic device 901 executes any function or service automatically or in response to a request, the electronic device 901 may not perform the function or the service internally, but, alternatively additionally, it may request at least a part of a function associated with the electronic device 901 at other device (e.g., the electronic device 902 or 904 or the server 906). The other electronic device (e.g., the electronic device 902 or 904 or the server 906) may execute the requested function or additional function and may transmit the execution result to the electronic device 901. The electronic device 901 may provide the requested function or service using the received result or may additionally process the received result to provide the requested function or service. To this end, for example, cloud computing, distributed computing, or client-server computing may be used.

Figure 10:
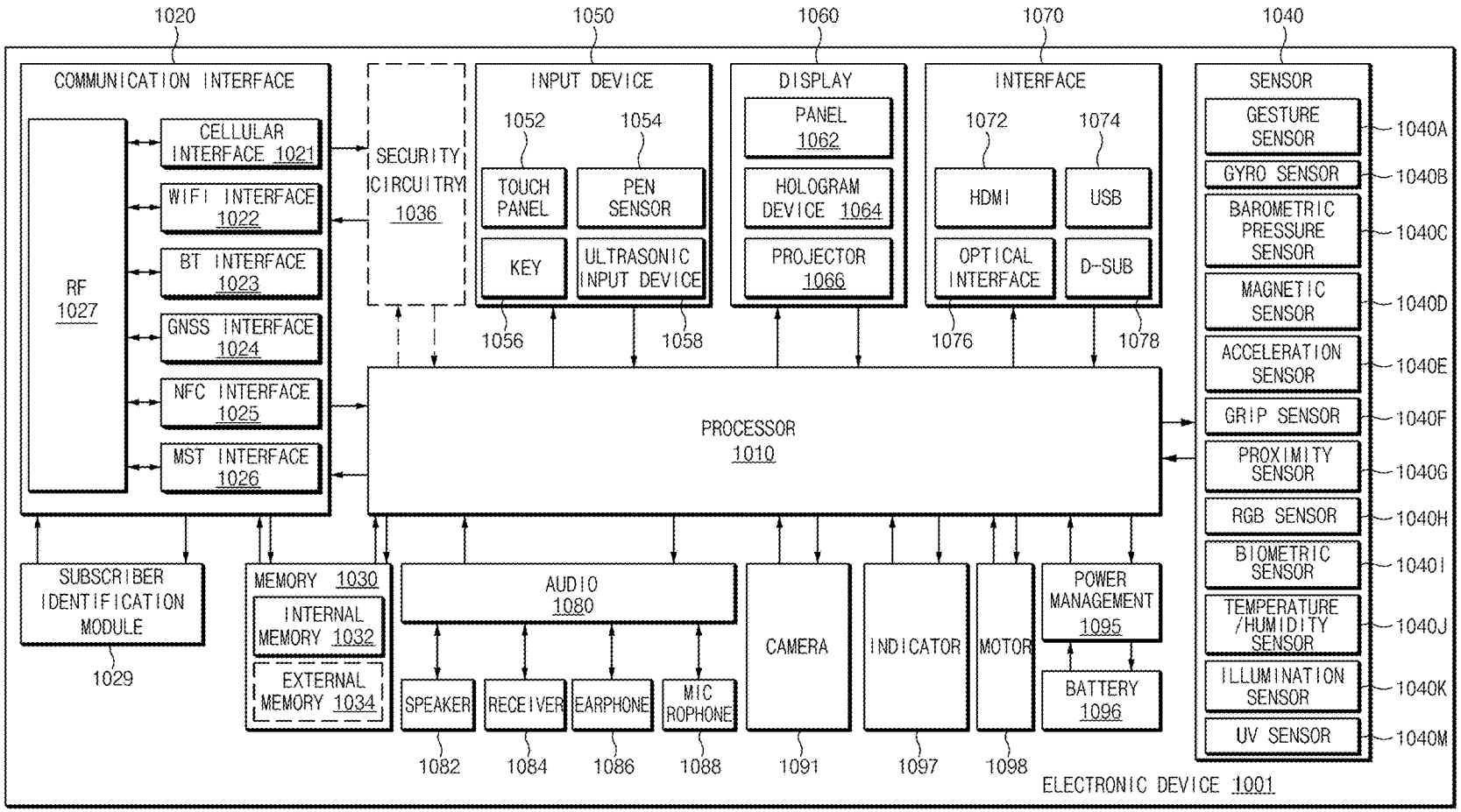
FIG. 10 illustrates an example an electronic device according to various embodiments of the present disclosure.

FIG. 10 illustrates an example electronic device according to various embodiments of the present disclosure.

Referring to FIG. 10, an electronic device 1001 may include, for example, all or a part of the electronic device 901 illustrated in FIG. 9. The electronic device 1001 may include one or more processors (e.g., an application processor) 1010, a communication interface 1020, a subscriber identification module 1024, a memory 1030, a sensor 1040, an input device 1050, a display 1060, an interface 1070, an audio 1080, a camera 1091, a power management 1095, a battery 1096, an indicator 1097, and a motor 1098.

The processor 1010 may drive, for example, an operating system (OS) or an application to control a plurality of hardware or software elements connected to the processor 1010 and may process and compute a variety of data. For example, the processor 1010 may be implemented with a System on Chip (SoC). According to an embodiment, the processor 1010 may further include a graphic processing unit (GPU) and/or an image signal processor. The processor 1010 may include at least a part (e.g., a cellular interface 1021) of elements illustrated in FIG. 10. The processor 1010 may load and process an instruction or data, which is received from at least one or more of other elements (e.g., a nonvolatile memory) and may store a variety of data in a nonvolatile memory.

The communication interface 1020 may be configured the same as or similar to the communication interface 970 of FIG. 9. The communication interface 1020 may include the cellular interface 1021, a Wi-Fi interface 1022, a Bluetooth (BT) module 1023, a GNSS interface 1024 (e.g., a GPS interface, a Glonass interface, a Beidou interface, or a Galileo interface), a near field communication (NFC) interface 1025, a MST interface 1026, and a radio frequency (RF) 1027.

The cellular interface 1021 may provide, for example, voice communication, video communication, a character service, an Internet service, or the like over a communication network. According to an embodiment, the cellular interface 1021 may perform discrimination and authentication of the electronic device 1001 within a communication network by using the subscriber identification module (e.g., a SIM card) 1029. According to an embodiment, the cellular interface 1021 may perform at least a portion of functions that the processor 1010 provides. According to an embodiment, the cellular interface 1021 may include a communication processor (CP).

Each of the Wi-Fi interface 1022, the BT interface 1023, the GNSS interface 1024, the NFC interface 1025, or the MST interface 1026 may include a processor for processing data exchanged through a corresponding module, for example. According to an embodiment, at least a part (e.g., two or more) of the cellular interface 1021, the Wi-Fi interface 1022, the BT interface 1023, the GNSS interface 1024, the NFC interface 1025, or the MST interface 1026 may be included within one Integrated Circuit (IC) or an IC package.

For example, the RF 1027 may transmit and receive a communication signal (e.g., an RF signal). For example, the RF 1027 may include a transceiver, a power amplifier module (PAM), a frequency filter, a low noise amplifier (LNA), an antenna, or the like. According to another embodiment, at least one or more of the cellular interface 1021, the Wi-Fi interface 1022, the BT interface 1023, the GNSS interface 1024, the NFC interface 1025, or the MST interface 1026 may transmit and receive an RF signal through a separate RF.

The subscriber identification module 1029 may include, for example, a card and/or embedded SIM that includes a subscriber identification module and may include unique identify information (e.g., integrated circuit card identifier (ICCID)) or subscriber information (e.g., integrated mobile subscriber identity (IMSI)).

The memory 1030 (e.g., the memory 930) may include an internal memory 1032 or an external memory 1034. For example, the internal memory 1032 may include at least one or more of a volatile memory (e.g., a dynamic random access memory (DRAM), a static RAM (SRAM), or a synchronous DRAM (SDRAM)), a nonvolatile memory (e.g., a one-time programmable read only memory (OTPROM), a programmable ROM (PROM), an erasable and programmable ROM (EPROM), an electrically erasable and programmable ROM (EEPROM), a mask ROM, a flash ROM, a flash memory (e.g., a NAND flash memory or a NOR flash memory)), a hard drive, or a solid state drive (SSD).

The external memory 1034 may further include a flash drive such as compact flash (CF), secure digital (SD), micro secure digital (Micro-SD), mini secure digital (Mini-SD), extreme digital (xD), a multimedia card (MMC), a memory stick, or the like. The external memory 1034 may be operatively and/or physically connected to the electronic device 1001 through various interfaces.

A security circuitry 1036 may be a module that includes a storage space of which a security level is higher than that of the memory 1030 and may be a circuit that guarantees safe data storage and a protected execution environment. The security circuitry 1036 may be implemented with a separate circuit and may include a separate processor. For example, the security circuitry 1036 may be in a smart chip or a secure digital (SD) card, which is removable, or may include an embedded secure element (eSE) embedded in a fixed chip of the electronic device 1001. Furthermore, the security circuitry 1036 may operate based on an operating system (OS) that is different from the OS of the electronic device 1001. For example, the security circuitry 1036 may operate based on Java card open platform (JCOP) OS.

The sensor 1040 may measure, for example, a physical quantity or may detect an operation state of the electronic device 1001. The sensor 1040 may convert the measured or detected information to an electric signal. Generally or additionally, the sensor 1040 may include at least one or more of a gesture sensor 1040A, a gyro sensor 1040B, a barometric pressure sensor 1040C, a magnetic sensor 1040D, an acceleration sensor 1040E, a grip sensor 1040F, the proximity sensor 1040G, a color sensor 1040H (e.g., red, green, blue (RGB) sensor), a biometric sensor 1040I, a temperature/humidity sensor 1040J, an illuminance sensor 1040K, or an UV sensor 1040M. Although not illustrated, additionally or generally, the sensor 1040 may further include, for example, an E-nose sensor, an electromyography sensor (EMG) sensor, an electroencephalogram (EEG) sensor, an electrocardiogram (ECG) sensor, an infrared (IR) sensor, an iris sensor, a fingerprint sensor, and the like. The sensor 1040 may further include a control circuit for controlling at least one or more sensors included therein. According to an embodiment, the electronic device 1001 may further include a processor that is a part of the processor 1010 or independent of the processor 1010 and is configured to control the sensor 1040. The processor may control the sensor 1040 while the processor 1010 remains at a sleep state.

The input device 1050 may include, for example, a touch panel 1052, a (digital) pen sensor 1054, a key 1056, or an ultrasonic input unit 1058. For example, the touch panel 1052 may use at least one or more of capacitive, resistive, infrared and ultrasonic detecting methods. Also, the touch panel 1052 may further include a control circuit. The touch panel 1052 may further include a tactile layer to provide a tactile reaction to a user.

The (digital) pen sensor 1054 may be, for example, a part of a touch panel or may include an additional sheet for recognition. The key 1056 may include, for example, a physical button, an optical key, a keypad, or the like. The ultrasonic input device 1058 may detect (or sense) an ultrasonic signal, which is generated from an input device, through a microphone (e.g., a microphone 1088) and may check data corresponding to the detected ultrasonic signal.

The display 1060 (e.g., the display 960) may include a panel 1062, a hologram device 1064, or a projector 1066. The panel 1062 may be configured to be the same as or similar to the display 960 illustrated in FIG. 9. The panel 1062 may be implemented, for example, to be flexible, transparent or wearable. The panel 1062 and the touch panel 1052 may be integrated into a single module. The hologram device 1064 may display a stereoscopic image in a space using a light interference phenomenon. The projector 1066 may project light onto a screen so as to display an image. The screen may be arranged in the inside or the outside of the electronic device 1001. According to an embodiment, the display 1060 may further include a control circuit for controlling the panel 1062, the hologram device 1064, or the projector 1066.

The interface 1070 may include, for example, a high-definition multimedia interface (HDMI) 1072, a universal serial bus (USB) 1074, an optical interface 1076, or a D-subminiature (D-sub) 1078. The interface 1070 may be included, for example, in the communication interface 970 illustrated in FIG. 9. Additionally or generally, the interface 1070 may include, for example, a mobile high definition link (MHL) interface, a SD card/multi-media card (MMC) interface, or an infrared data association (IrDA) standard interface.

The audio 1080 may convert a sound and an electric signal in dual directions. At least a part of the audio 1080 may be included, for example, in the input/output interface 950 illustrated in FIG. 9. The audio 1080 may process, for example, sound information that is input or output through a speaker 1082, a receiver 1084, an earphone 1086, or the microphone 1088.

The camera 1091 for shooting a still image or a video may include, for example, at least one or more image sensors (e.g., a front sensor or a rear sensor), a lens, an image signal processor (ISP), or a flash (e.g., an LED or a xenon lamp).

The power management 1095 may manage, for example, power of the electronic device 1001. According to an embodiment, a power management integrated circuit (PMIC), a charger IC, or a battery or fuel gauge may be included in the power management 1095. The PMIC may have a wired charging method and/or a wireless charging method. The wireless charging method may include, for example, a magnetic resonance method, a magnetic induction method or an electromagnetic method and may further include an additional circuit, for example, a coil loop, a resonant circuit, or a rectifier, and the like. The battery gauge may measure, for example, a remaining capacity of the battery 1096 and a voltage, current or temperature thereof while the battery is charged. The battery 1096 may include, for example, a rechargeable battery and/or a solar battery.

The indicator 1097 may display a specific state of the electronic device 1001 or a part thereof (e.g., the processor 1010), such as a booting state, a message state, a charging state, and the like. The motor 1098 may convert an electrical signal into a mechanical vibration and may generate the following effects: vibration, haptic, and the like. Although not illustrated, a processing device (e.g., a GPU) for supporting a mobile TV may be included in the electronic device 1001. The processing device for supporting the mobile TV may process media data according to the standards of digital multimedia broadcasting (DMB), digital video broadcasting (DVB), MediaFlo™, or the like.

Each of the above-mentioned elements of the electronic device according to various embodiments of the present disclosure may be configured with one or more components, and the names of the elements may be changed according to the type of the electronic device. In various embodiments, the electronic device may include at least one or more of the above-mentioned elements, and some elements may be omitted or other additional elements may be added. Furthermore, some of the elements of the electronic device according to various embodiments may be combined with each other so as to form one entity, so that the functions of the elements may be performed in the same manner as before the combination.

Figure 11:
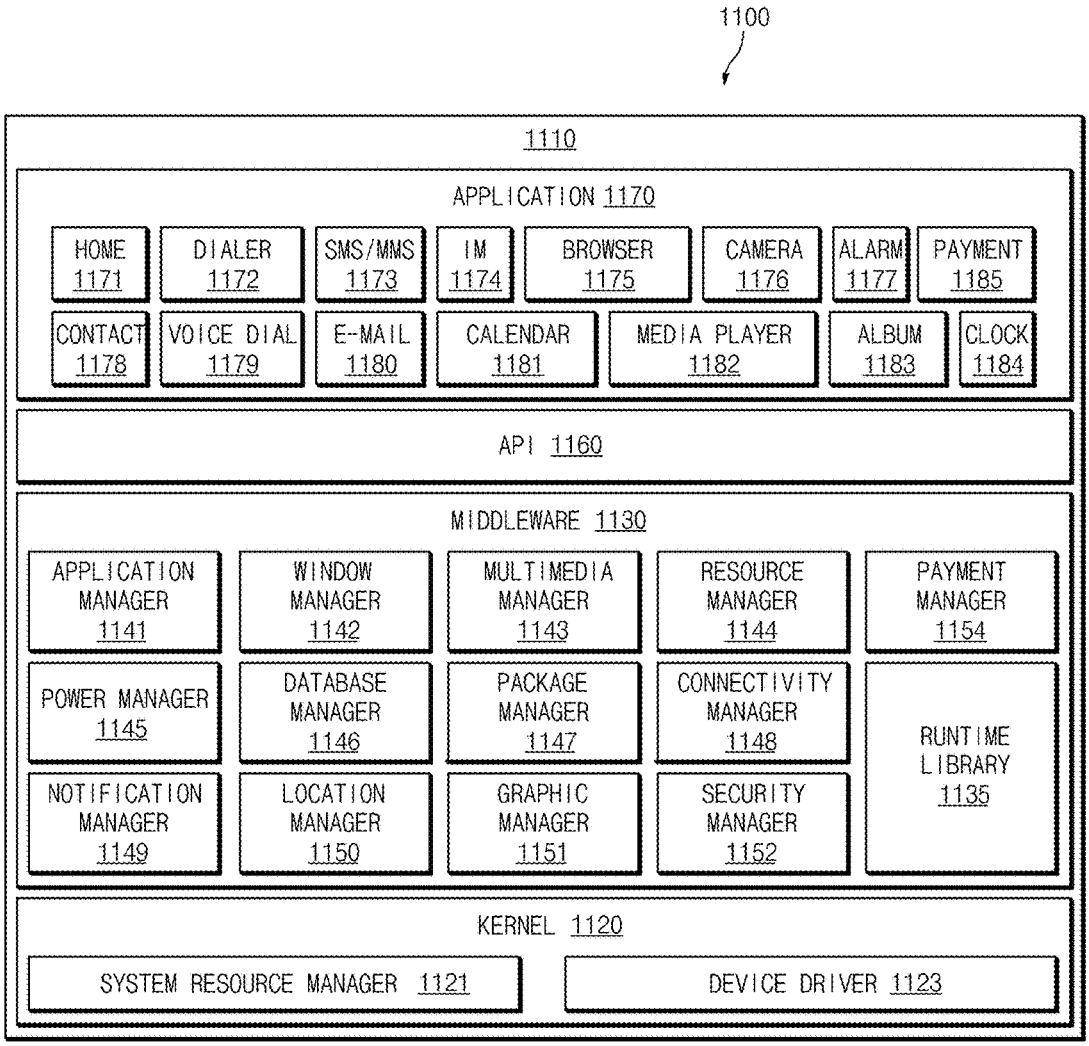
FIG. 11 illustrates an example program module according to various embodiments of the present disclosure.

FIG. 11 illustrates an example program module, according to various embodiments of the present disclosure.

According to an embodiment, a program module 1110 (e.g., the program 940) may include an operating system (OS) to control resources associated with an electronic device (e.g., the electronic device 901), and/or diverse applications (e.g., the application program 947) driven on the OS. The OS may be, for example, Android™, iOS™, Windows™, Symbian™, Tizen™, or Samsung bada OS™.

The program module 1110 may include a kernel 1120, a middleware 1130, an application programming interface (API) 1160, and/or an application 1170. At least a part of the program module 1110 may be preloaded on an electronic device or may be downloadable from an external electronic device (e.g., the electronic device 902 or 904, the server 906, and the like).

The kernel 1120 (e.g., the kernel 941) may include, for example, a system resource manager 1121 or a device driver 1123. The system resource manager 1121 may perform control, allocation, or retrieval of system resources. According to an embodiment, the system resource manager 1121 may include a process managing unit, a memory managing unit, or a file system managing unit. The device driver 1123 may include, for example, a display driver, a camera driver, a Bluetooth driver, a shared memory driver, a USB driver, a keypad driver, a Wi-Fi driver, an audio driver, or an inter-process communication (IPC) driver.

The middleware 1130 may provide, for example, a function that the application 1170 needs in common, or may provide diverse functions to the application 1170 through the API 1160 to allow the application 1170 to efficiently use limited system resources of the electronic device. According to an embodiment, the middleware 1130 (e.g., the middleware 943) may include at least one or more of a runtime library 1135, an application manager 1141, a window manager 1142, a multimedia manager 1143, a resource manager 1144, a power manager 1145, a database manager 1146, a package manager 1147, a connectivity manager 1148, a notification manager 1149, a location manager 1150, a graphic manager 1151, a security manager 1152, or a payment manager 1154.

The runtime library 1135 may include, for example, a library module that is used by a compiler to add a new function through a programming language while the application 1170 is being executed. The runtime library 1135 may perform input and/or output management, memory management, or capacities about arithmetic functions.

The application manager 1141 may manage, for example, a life cycle of at least one application of the application 1170. The window manager 1142 may manage a GUI resource that is used in a screen. The multimedia manager 1143 may identify a format necessary for playing diverse media files, and may perform encoding or decoding of media files by using a codec suitable for the format. The resource manager 1144 may manage resources such as a storage space, memory, or source code of at least one application of the application 1170.

The power manager 1145 may operate, for example, with a basic input/output system (BIOS) to manage a battery or power, and may provide power information for an operation of an electronic device. The database manager 1146 may generate, search for, or modify database that is to be used in at least one application of the application 1170. The package manager 1147 may install or update an application that is distributed in the form of package file.

The connectivity manager 1148 may manage, for example, wireless connection such as Wi-Fi or Bluetooth. The notification manager 1149 may display or notify an event such as arrival message, appointment, or proximity notification in a mode that does not disturb a user. The location manager 1150 may manage location information about an electronic device. The graphic manager 1151 may manage a graphic effect that is provided to a user, or manage a user interface relevant thereto. The security manager 1152 may provide a general security function necessary for system security or user authentication. According to an embodiment, in the case where an electronic device (e.g., the electronic device 901) includes a telephony function, the middleware 1130 may further includes a telephony manager for managing a voice or video call function of the electronic device.

The middleware 1130 may include a middleware module that combines diverse functions of the above-described elements. The middleware 1130 may provide a module specialized to each OS kind to provide differentiated functions. Additionally, the middleware 1130 may dynamically remove a part of the preexisting elements or may add new elements thereto.

The API 1160 (e.g., the API 945) may be, for example, a set of programming functions and may be provided with a configuration that is variable depending on an OS. For example, in the case where an OS is the android or the iOS, it may be permissible to provide one API set per platform. In the case where an OS is the Tizen, it may be permissible to provide two or more API sets per platform.

The application 1170 (e.g., the application program 947) may include, for example, one or more applications capable of providing functions for a borne 1171, a dialer 1172, an SMS/MMS 1173, an instant message (IM) 1174, a browser 1175, a camera 1176, an alarm 1177, a contact 1178, a voice dial 1179, an e-mail 1180, a calendar 1181, a media player 1182, an album 1183, and a timepiece 1184, or for offering health care (e.g., measuring an exercise quantity, blood sugar, or the like) or environment information (e.g., atmospheric pressure, humidity, temperature, or the like).

According to an embodiment, the application 1170 may include an application (hereinafter referred to as "information exchanging application" for descriptive convenience) to support information exchange between an electronic device (e.g., the electronic device 901) and an external electronic device (e.g., the electronic device 902 or 904). The information exchanging application may include, for example, a notification relay application for transmitting specific information to an external electronic device, or a device management application for managing the external electronic device.

For example, the notification relay application may include a function of transmitting notification information, which arise from other applications (e.g., applications for SMS/MMS, e-mail, health care, or environmental information), to an external electronic device (e.g., the electronic device 902 or 904). Additionally, the information exchanging application may receive, for example, notification information from an external electronic device and provide the notification information to a user.

The device management application may manage (e.g., install, delete, or update), for example, at least one function (e.g., turn-on/turn-off of an external electronic device (or a part of elements) or adjustment of brightness (or resolution) of a display) of the external electronic device (e.g., the electronic device 902 or 904) which communicates with the electronic device, an application running in the external electronic device, or a service (e.g., a call service, a message service, or the like) provided from the external electronic device.

According to an embodiment, the application 1170 may include an application (e.g., a health care application of a mobile medical device) that is assigned in accordance with an attribute of an external electronic device (e.g., the electronic device 902 or 904). According to an embodiment, the application 1170 may include an application that is received from an external electronic device (e.g., the server 906 or the electronic device 902 or 904). According to an embodiment, the application 1170 may include a preloaded application or a third party application that is downloadable from a server. The element titles of the program module 1110 according to the embodiment may be modifiable depending on kinds of operating systems.

According to various embodiments, at least a part of the program module 1110 may be implemented by software, firmware, hardware, or a combination of two or more thereof. At least a portion of the program module 1110 may be implemented (e.g., executed), for example, by the processor (e.g., the processor 1010). At least a portion of the program module 1110 may include, for example, modules, programs, routines, a plurality of sets of instructions, processes, or the like for performing one or more functions.

The term "module" used herein may represent, for example, a unit including one or more combinations of hardware, software and firmware. The term "module" may be interchangeably used with the terms "unit", "logic", "logical block", "component" and "circuit". The "module" may be a minimum unit of an integrated component or may be a part thereof. The "module" may be a minimum unit for performing one or more functions or a part thereof. The "module" may be implemented mechanically or electronically. For example, the "module" may include at least one or more of an application-specific IC (ASIC) chip, a field-programmable gate array (FPGA), and a programmable-logic device for performing some operations, which are known or will be developed.

At least a part of an apparatus (e.g., modules or functions thereof) or a method (e.g., operations) according to various embodiments may be, for example, implemented by instructions stored in a computer-readable storage media in the form of a program module. The instruction, when executed by a processor (e.g., the processor 920), may cause the one or more processors to perform a function corresponding to the instruction. The computer-readable storage media, for example, may be the memory 930.

A computer-readable recording medium may include a hard disk, a floppy disk, a magnetic media (e.g., a magnetic tape), an optical media (e.g., a compact disc read only memory (CD-ROM) and a digital versatile disc (DVD), a magneto-optical media (e.g., a floptical disk)), and hardware devices (e.g., a read only memory (ROM), a random access memory (RAM), or a flash memory). Also, a program instruction may include not only a mechanical code such as things generated by a compiler but also a high-level language code executable on a computer using an interpreter.

The above hardware unit may be configured to operate via one or more software modules for performing an operation of the present disclosure, and vice versa.

A module or a program module according to various embodiments may include at least one or more of the above elements, or a part of the above elements may be omitted, or additional other elements may be further included. Operations performed by a module, a program module, or other elements according to various embodiments may be executed sequentially, in parallel, repeatedly, or in a heuristic method. In addition, some operations may be executed in different sequences or may be omitted. Alternatively, other operations may be added.

According to embodiments disclosed in this disclosure, a circuit is used to allow the impedance of an antenna in idle state to be mismatched to a frequency band of a signal transmitted and/or received in an SISO mode, such that the performance of an antenna in use may be prevented from being deteriorated by an antenna in idle state.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. An electronic device comprising:

a first antenna radiator configured to transmit and/or receive a signal of a first frequency band and a signal of a second frequency band;

a second antenna radiator configured to transmit and/or receive the signal of the second frequency band, wherein at least a part of the second antenna radiator is arranged to be coupled with the first antenna radiator and includes a pattern having an electrical length corresponding to the first frequency band;

a matching circuit electrically connected to the second antenna radiator, wherein the matching circuit is mismatched with the second antenna radiator in the first frequency band and is matched with the second antenna radiator in the second frequency band;

a radio frequency (RF) circuit electrically connected to the first antenna radiator and the second antenna radiator; and a processor configured to control the RF circuit such that the signal of the second frequency band is transmitted or received through the first antenna radiator and the second antenna radiator in a multi-input multi-output (MIMO) mode or such that the signal of the first frequency band is transmitted and/or received through the first antenna radiator in a single input single output (SISO) mode, wherein:

the matching circuit is controlled to be mismatched with the second antenna radiator when the signal of the first frequency band is transmitted or received through the first antenna radiator in the SISO mode;

the first antenna radiator includes a first metal frame and a conductive pattern;

the second antenna radiator includes a first pattern and a second pattern;

the first pattern is coupled with the conductive pattern;

the first pattern extends in a direction opposite to that of a second elongated conductive member to be longer than the second elongated conductive member; and the first pattern exerts an influence on a resonance frequency of the first antenna radiator in the first frequency band.

2. The electronic device of claim 1, further comprising a metal frame, wherein the first antenna radiator includes a part of the metal frame and the conductive pattern electrically connected to the part of the metal frame.

3. The electronic device of claim 2, further comprising a display, wherein the conductive pattern is arranged below a black matrix area of the display.

4. The electronic device of claim 1, wherein the second antenna radiator includes:

a first pattern having the electrical length corresponding to the first frequency band; and a second pattern extending in a different direction from a direction of the first pattern and having an electrical length corresponding to the second frequency band.

5. The electronic device of claim 4, further comprising a display, wherein the first pattern and the second pattern are arranged below a black matrix area of the display.

6. The electronic device of claim 1, wherein the first antenna radiator has the resonance frequency higher than a frequency in the first frequency band.

7. The electronic device of claim 1, wherein the first antenna radiator is configured to transmit and/or receive a Wi-Fi signal of 2.4 GHz or 5 GHz, and wherein the second antenna radiator is configured to transmit and/or receive the Wi-Fi signal of 5 GHz.

8. An electronic device comprising:

a first antenna radiator configured to transmit and/or receive a signal of a first frequency band and a signal of a second frequency band;

a second antenna radiator configured to transmit and/or receive the signal of the first frequency band and the signal of the second frequency band, wherein the second antenna radiator includes a first pattern having an electrical length corresponding to the first frequency band, wherein a second pattern has an electrical length corresponding to the second frequency band, and wherein the first pattern is arranged to be coupled with the first antenna radiator;

a tuning circuit electrically connected to the second antenna radiator;

a radio frequency (RF) circuit electrically connected to the first antenna radiator and the second antenna radiator; and a processor configured to control the tuning circuit such that the second antenna radiator is matched in the first frequency band when the RF circuit transmits and/or receives the signal of the first frequency band through the first antenna radiator and the second antenna radiator in a multi-input multi-output (MIMO) mode, and such that the second antenna radiator is mismatched in the first frequency band when the RF circuit transmits and/or receives the signal of the first frequency band through the first antenna radiator in a single-input single-output (SISO) mode, wherein:

a matching circuit is controlled to be mismatched with the second antenna radiator when the signal of the first frequency band is transmitted or received through the first antenna radiator in the SISO mode;

the first antenna radiator includes a first metal frame and a conductive pattern;

the second antenna radiator includes a first pattern and a second pattern;

the first pattern is coupled with the conductive pattern;

the first pattern extends in a direction opposite to that of a second elongated conductive member to be longer than the second elongated conductive member; and the first pattern exerts an influence on a resonance frequency of the first antenna radiator in the first frequency band.

9. The electronic device of claim 8, wherein the tuning circuit includes at least one of a switch, a tuner, or a variable capacitor.

10. The electronic device of claim 8, further comprising a feed and a ground that are electrically connected to the second antenna radiator, wherein the tuning circuit is interposed between the second antenna radiator and at least one of the feed or the ground.

11. The electronic device of claim 8, wherein, when the signal of the first frequency band is transmitted and/or received through the first antenna radiator in the SISO mode, the tuning circuit is configured to increase at least one of a bandwidth or an efficiency of the first antenna radiator in the first frequency band.

12. The electronic device of claim 8, wherein, when the signal of the first frequency band is transmitted or received through the first antenna radiator in the SISO mode, the processor is configured to control the tuning circuit such that the resonance frequency of the first antenna radiator is changed.

13. The electronic device of claim 11, wherein the processor is further configured to control the RF circuit based on information associated with a communication state received from a repeater communicating with the electronic device such that the signal of the first frequency band is transmitted or received through at least one of the first antenna radiator or the second antenna radiator in the MIMO mode or the SISO mode.

14. An electronic device comprising:

a housing including a first surface facing a first direction, a second surface facing a second direction opposite to the first direction, and a side surface surrounding at least a part of a space between the first surface and the second surface;

a first elongated conductive member defining a first part of the side surface and including a first end;

a second elongated conductive member defining a second part of the side surface and including a second end adjacent to the first end;

a non-conductive member defining a third part of the side surface and inserted between the first end and the second end;

a first conductive pattern arranged inside of the housing to be closer to the first elongated conductive member than the second elongated conductive member;

a second conductive pattern arranged inside of the housing to be closer to the second elongated conductive member than the first elongated conductive member; and a wireless communication circuit electrically connected to at least one of:

the first elongated conductive member and the first conductive pattern to transmit and/or receive a signal of a first frequency band; or the first conductive pattern and the second conductive pattern to transmit and/or receive a signal of a second frequency band higher than the first frequency band, wherein the second conductive pattern includes an elongated conductive part and is adjacent to the second elongated conductive member, wherein:

the second conductive pattern includes a first pattern and a second pattern;

the first pattern is an elongated conductive part and is adjacent to the second elongated conductive member;

the second pattern has an electrical length corresponding to the second frequency band and extends in a direction different from that of the first pattern;

the first pattern is coupled with the first conductive pattern;

the first pattern extends in a direction opposite to that of the second elongated conductive member to be longer than the second elongated conductive member; and the first pattern exerts an influence on a resonance frequency of a first antenna radiator in the first frequency band.

15. The electronic device of claim 14, wherein the wireless communication circuit includes a Wi-Fi communication circuit configured to support a 2.4 GHz band and a 5 GHz band.

16. The electronic device of claim 14, wherein the elongated conductive part extends in a direction opposite to a direction of the second conductive pattern, extends longer than the second conductive pattern, and is adjacent to the second elongated conductive member.

17. The electronic device of claim 14, wherein the first frequency band includes a band of 2.4 GHz to 2.8 GHz.

18. The electronic device of claim 14, wherein the second frequency band includes a band of 5 GHz to 5.8 GHz.

* * * * *